US007750221B2

(12) United States Patent
Terada

(10) Patent No.: US 7,750,221 B2
(45) Date of Patent: Jul. 6, 2010

(54) KEYBOARD-TYPE TONE PLATE PERCUSSION INSTRUMENT AND RESONANCE TUBE AND RESONANCE BOX FOR TONE PLATE PERCUSSION INSTRUMENT

(75) Inventor: Norishige Terada, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 0 days.

(21) Appl. No.: 11/610,013

(22) Filed: Dec. 13, 2006

(65) Prior Publication Data

US 2007/0137458 A1 Jun. 21, 2007

(30) Foreign Application Priority Data

Dec. 13, 2005 (JP) ..... 2005-359314
Dec. 13, 2005 (JP) ..... 2005-359316
Feb. 24, 2006 (JP) ..... 2006-048034

(51) Int. Cl.
*G10C 3/04* (2006.01)
*G10D 13/08* (2006.01)

(52) U.S. Cl. ..... 84/423 R; 84/170; 84/185; 84/189; 84/237; 84/404; 84/410; 84/427

(58) Field of Classification Search ..... 84/24, 84/25, 27, 28, 30, 57, 60, 61, 172, 184, 187, 84/189–196, 294, 296, 402–404, 410, 427, 84/423, 236, 237, 371, 240, 216, 220, 423 R
See application file for complete search history.

(56) References Cited

U.S. PATENT DOCUMENTS 1,192,324 A 7/1916 Kohler
1,369,268 A * 2/1921 Deagan ..... 84/410
1,532,793 A 4/1925 Zepeda (Continued)

FOREIGN PATENT DOCUMENTS

AT 405 345 B 7/1999

(Continued)

OTHER PUBLICATIONS

"Celesta", Wikipedia, I'encyclopdie libre, Online, Sep. 21, 2004, p. 1, XP-002419666.

(Continued)

*Primary Examiner*—Jeffrey Donels
*Assistant Examiner*—Christopher Uhlir
(74) *Attorney, Agent, or Firm*—Dickstein Shapiro LLP

(57) ABSTRACT

A keyboard-type tone plate percussion instrument which is simple in construction and light in weight and capable of easily unifying key-operation feelings and efficiently outputting well-balanced sounds. Percussion units are arranged to respectively correspond to keys and tone plates and each strike a corresponding tone plate when driven by a key depressing operation. A resonance box has resonance chambers corresponding to the tone plates and each having an opening side thereof close to a corresponding tone plate. The tone plates are constructed into a single-stage structure where they are arranged in an order of tone pitch in a direction of array of the keys so that tone plates neighboring in specific tone pitch are arranged adjacent to each other. The percussion units are constructed into a single-stage structure where they are arranged to correspond to array of the tone plates.

12 Claims, 23 Drawing Sheets

U.S. PATENT DOCUMENTS

| | | | | | |
|---|---|---|---|---|---|
| 1,807,057 | A | | 5/1931 | Bowers | |
| 1,838,502 | A | | 12/1931 | Schluter | |
| 2,020,150 | A | | 11/1935 | Ludwig et al. | |
| 2,239,204 | A | * | 4/1941 | Socin | 84/240 |
| 2,315,812 | A | | 4/1943 | O'Connell | |
| 2,971,424 | A | | 2/1961 | Kent et al. | |
| 3,138,986 | A | * | 6/1964 | Musser | 84/410 |
| 3,595,119 | A | * | 7/1971 | Kuijpers | 84/403 |
| 3,858,477 | A | * | 1/1975 | Kawakami | 84/410 |
| 4,111,094 | A | * | 9/1978 | Broser | 84/402 |
| 5,235,892 | A | * | 8/1993 | Terada et al. | 84/404 |
| 5,313,867 | A | * | 5/1994 | Terada et al. | 84/404 |
| 5,986,194 | A | * | 11/1999 | Schwartz et al. | 84/404 |

FOREIGN PATENT DOCUMENTS

| | | | |
|---|---|---|---|
| DE | 445 861 | | 6/1927 |
| DE | 91 10 619 | U1 | 10/1991 |
| DE | 103 57 326 | A1 | 6/2005 |
| EP | 0 489 430 | | 4/1991 |
| EP | 0 723 255 | A2 | 7/1996 |
| EP | 0 831 454 | A2 | 3/1998 |
| GB | 144 247 | | 9/1920 |
| JP | 5-81895 | A | 4/1993 |
| JP | 5-81895 | U | 11/1993 |
| JP | 8-202351 | | 8/1996 |
| NL | 7605085 | | 11/1977 |

OTHER PUBLICATIONS

Jim McCarthy, "Marimbas:Exploring the Depths", Honours Essay, , XP002470150, www.percussionclinic.com/art-mb.asa.

* cited by examiner 100A
103A

103A 100B
104B
102
RM5
101
101
103B
102

103B
104B
102
RM5
101
61
101
102
100

100C
104C
103C 103C
104C 100D
104D
103D 103D
104D

KEYBOARD-TYPE TONE PLATE PERCUSSION INSTRUMENT AND RESONANCE TUBE AND RESONANCE BOX FOR TONE PLATE PERCUSSION INSTRUMENT

BACKGROUND OF THE INVENTION

1. Field of the Invention

The present invention relates to a keyboard-type tone plate percussion instrument that generates a musical tone when a corresponding tone plate is struck by a corresponding percussion unit in response to a key depression operation, and relates to a resonance tube and a resonance box for a tone plate percussion instrument that cause a musical tone generated by a tone plate to resonate therein.

2. Description of the Related Art

As disclosed in Japanese Utility Model Laid-open Publication (Kokai) No. H05-081895, there has been known a keyboard-type tone plate percussion instrument including tone plates and percussion units such as hammer action units and adapted to generate a musical tone of a specific tone pitch when a corresponding tone plate is struck by a corresponding percussion unit in response to a key depression operation.

In this keyboard-type tone plate percussion instrument, the tone plates are fixed for vibration to a supporting part of the instrument by means of a pin or the like, resonance boxes are provided each having an opening side thereof arranged close to the tone plates, and each percussion unit is disposed below a corresponding tone plate. The just-mentioned mechanism is constructed in an upper and lower two-stage fashion. Specifically, the tone plate group, percussion unit group and resonance box which correspond to white keys are arranged in an upper part of the percussion instrument, whereas the tone plate group, percussion unit group and resonance box corresponding to black keys are arranged in a lower part of the instrument.

The aforementioned two-stage structure is needed mainly to meet a demand that each resonance chamber of the resonance boxes must have the required width large enough to achieve a satisfactory resonance function, which cannot be achieved if the resonance chamber is too small in width in the direction in which the tone plates are arranged. For this reason, as in the case of the aforementioned prior art, the tone plate percussion instrument is ordinarily provided with resonance boxes constructed into an upper and lower two-stage fashion, thereby making it easy to ensure the required width of each resonance chamber of the resonance boxes.

In the conventional tone plate percussion instrument, there are used different types of resonance boxes for different ranges. Specifically, Helmholtz-type, closed-tube type, and single-type resonance boxes are used in an increasing order of tone pitch as seen from the side of the lowest tone range of the instrument. Each resonance chamber of the resonance boxes has an opening thereof that opens toward the tone plates and is fully closed on the side thereof opposite from the tone plates.

Among these resonance boxes, the single-type resonance box has a single resonance chamber common to a plurality of tone plates associated therewith, whereas the Helmholtz-type and closed-tube type resonance boxes each have resonance chambers corresponding to respective ones of a plurality of tone pitches concerned, wherein each resonance chamber is constructed to have a natural resonance frequency, so as to cause a musical tone of a tone pitch (frequency) generated by a corresponding tone plate to efficiently resonate therein.

To this end, the closed-tube type resonance box is mostly constructed such that the resonance chambers thereof are different in length and hence different in volume to have different natural resonance frequencies from one another. As for the Helmholtz type resonance box, the resonance frequency of each resonance chamber can be adjusted by varying the opening area of its opening (port) that opens toward tone plates. In the above-described conventional tone plate percussion instrument, therefore, the tube length and port opening area are variously combined to differentiate the natural resonance frequency between the resonance chambers.

However, in the conventional tone plate percussion instrument having the resonance box of an upper and lower two-stage structure, the tone plates and the percussion units must also be constructed into an upper and lower two-stage structure, resulting in the following disadvantages.

First, the percussion instrument requiring the two-staged resonance box becomes large in size as a whole. Furthermore, long coupling rods are required for transmission of key depressing operations to the lower percussion unit group, resulting in a further increase in the entire size of the instrument. In addition, the provision of the coupling rods results in not only complicated construction and increased weight of the instrument but also heavier feelings in operating the lower percussion units than in operating the upper percussion units. To unify key-depression feelings between when the upper percussion unit is operated and when the lower percussion unit is operated, the feeling in operating the upper percussion unit must be adjusted to be close to the feeling in operating the lower percussion unit, which disadvantageously results in heavy key-depression feeling as a whole.

Furthermore, since the tone plate group corresponding to the white keys is vertically separated in position from the tone plate group corresponding to the black keys, the sounding position differs between these two groups, and therefore, the volume of sound and how the sound is heard by the listener vary between the two tone plate groups depending on the listener position, making it difficult to balance sounds therebetween. In addition, musical tones sounded by the upper tone plates are interrupted by the lower tone plate group, lower percussion unit group and lower resonance box, making it difficult to efficiently output sounds. This poses a problem that it is difficult to attain well-balanced appropriate sounds.

As explained above, it is essentially required to construct the resonance box and the like into a two-stage structure in order to ensure that each resonance chamber of the resonance box has the required width, which poses problems such as the increased entire size of the musical instrument. Similar problems are also encountered in tone plate percussion instruments provided with no percussion units.

Moreover, especially in the closed-tube type resonance box, the resonance frequency of each resonance chamber can only be adjusted by adjusting the volume of the resonance chamber. In addition, the resonance chambers must be so arranged as to correspond to the array of the tone plates, and hence the resonance chamber is limited in width size in the direction in which the tone plates are arranged. As a result, the resonance frequency of each resonance chamber is adjusted solely by varying the tube length. As a consequence, the size especially the height size of each resonance chamber is fixed, which disadvantageously lowering the degree of freedom in design.

SUMMARY OF THE INVENTION

A first object of the present invention is to provide a keyboard-type tone plate percussion instrument which is simple in construction and light in weight and capable of easily unifying key-operation feelings and efficiently outputting well-balanced sounds.

A second object of the present invention is to provide a resonance box for use in a tone plate percussion instrument, which is capable of ensuring that resonance chambers each have an appropriate width large enough to realize a satisfactory resonance and of realizing a single-stage structure where a resonance box and tone plates are arranged in a single-stage fashion.

A third object of the present invention is to provide a resonance tube and a resonance box for use in a tone plate percussion instrument, wherein the resonance tube and resonance box each have the side thereof, opposite from tone plates, formed with openings for adjustment of natural resonance frequencies of resonance chambers thereof, thereby increasing the degree of freedom in design.

To attain the first object, according to a first aspect of the present invention, there is provided a keyboard-type tone plate percussion instrument comprising a plurality of keys that constitute a keyboard, a plurality of tone plates each sounding a musical tone of a specific tone pitch when struck, a plurality of percussion units arranged to respectively correspond to the plurality of keys and the plurality of tone plates, each percussion unit striking a corresponding one of the plurality of tone plates when driven by a depressing operation of a corresponding one of the plurality of keys, and a resonance box having a plurality of resonance chambers corresponding to respective ones of the plurality of tone plates and each having an opening side thereof close to a corresponding one of the plurality of tone plates, wherein the plurality of tone plates are constructed into a single-stage structure where they are arranged in an order of tone pitch in a direction in which the plurality of keys are arranged so that tone plates neighboring in specific tone pitch are arranged adjacent to each other, and wherein the plurality of percussion units are constructed into a single-stage structure where they are arranged in the direction in which the plurality of keys are arranged so as to correspond to array of the plurality of tone plates.

With the above construction, the percussion instrument can be made simple in construction and light in weight, key-operation feelings can easily be made unified, and well-balanced sounds can be efficiently output.

Preferably, the plurality of percussion units are disposed on a side of the percussion instrument opposite from the resonance box with respect to the plurality of tone plates, and the percussion instrument further includes sound output holes that are provided on a side of the percussion instrument opposite from the plurality of tone plates with respect to the plurality of percussion units.

With this construction, sounds can be output from the tone plates directly to the outside, thereby enhancing the efficiency of outputting sounds.

Preferably, the resonance box includes first and second common walls extending substantially along the direction in which the plurality of tone plates are arranged, and a plurality of chamber-defining members that are formed between the first and second common walls and define the plurality of resonance chambers, among the plurality of resonance chambers, a plurality of predetermined resonance chambers corresponding to at least part of a range of the percussion instrument are defined to correspond, on a one on one basis, to associated ones of the plurality of tone plates, each of the plurality of predetermined resonance chambers overlaps at least one of other predetermined resonance chambers as seen from front thereof, and a maximum width of each of the plurality of predetermined resonance chambers as viewed in the direction in which the plurality of tone plates are arranged is as large as at least twice a width of the corresponding tone plate.

With this construction, a proper width of each resonance chamber can be ensured, and the resonance box and the tone plates of the percussion instrument can be constructed in a single-stage fashion.

Preferably, each of the resonance chambers has a first opening thereof formed on the opening side of the resonance chamber, the first opening communicating with the resonance chamber, and facing and opening toward a corresponding one of the tone plates, and each resonance chamber has a side thereof, opposite from the opening side, formed with a second opening that communicates with the resonance chamber, the second opening being located remote from and opening in a direction away from the corresponding one of the tone plates.

With this construction, the natural resonance frequency of each resonance chamber can be adjusted by means the second opening formed on the side of the resonance chamber remote from the tone plate concerned as well as the first opening formed on the side of the resonance chamber close to the tone plate, thereby making it possible to increase the degree of freedom in designing the resonance chambers.

Preferably, each of the resonance chambers has a first opening thereof formed on the opening side of the resonance chamber, the first opening communicating with the resonance chamber, and facing and opening toward a corresponding one of the tone plates, each resonance chamber has a side thereof, opposite from the opening side, formed with a second opening that communicates with the resonance chamber, the second opening being located remote from and opening in a direction away from the corresponding one of the tone plates, and the second openings of the resonance chambers are different in at least one of opening area and opening depth from one another, whereby each resonance chamber causes the musical tone of the specific tone pitch sounded by the corresponding one of the tone plates to resonate therein.

With this construction, the natural resonance frequency of each resonance chamber can be adjusted by means the opening area and/or the opening depth of the second opening formed on the side of the resonance chamber remote from the tone plate concerned as well as the first opening formed on the side of the resonance chamber close to the tone plate, thereby making it possible to increase the degree of freedom in designing the resonance chambers.

Preferably, each of the plurality of predetermined resonance chambers is in an overlap relation with the other one of the plurality of predetermined resonance chambers, those predetermined resonance chambers which are in the overlap relation with each other are the same in height, and that predetermined resonance chamber which corresponds to a higher pitch range is smaller in height.

With this construction, it is possible to reduce a difference between the sizes of the second openings located remote from the tone plates and opening in a direction away from the tone plates, thereby suppressing a variation in sound volume between the resonance chambers.

To attain the second object, according to the second aspect of the present invention, there is provided a resonance box for use in a tone plate percussion instrument, which is disposed close to a plurality of tone plates and causes a musical tone generated by each of the tone plates to resonate therein, comprising first and second common walls extending substantially along a direction in which the plurality of tone plates are arranged, and a plurality of chamber-defining members that are formed between the first and second common walls and define a plurality of resonance chambers, wherein, among the plurality of resonance chambers, a plurality of predetermined resonance chambers corresponding to at least part of a range of the percussion instrument are defined to correspond, on a one on one basis, to associated ones of the plurality of tone plates, each of the plurality of predetermined resonance chambers overlaps at least one of other predetermined resonance chambers as seen from front thereof, and a maximum width of each of the plurality of predetermined resonance chambers as viewed in the direction in which the plurality of tone plates are arranged is as large as at least twice a width of the corresponding tone plate.

According to this construction, the desired width of each resonance chamber can be ensured, and the resonance box and tone plates of the percussion instrument can be constructed into a single-stage structure.

Preferably, a predetermined imaginary straight line passes through all the predetermined resonance chambers.

With this construction, longitudinal positions of antinodes in tone plates can be aligned to thereby unify feelings of operating the tone plates, and the tone plates can be made compact in longitudinal size.

Preferably, each of the chamber-defining members includes a plurality of first plate members connected to at least one of said first and second common walls, and a plurality of second plate members connected to at least two of the first plate members.

With this construction, the resonance chambers can be defined with simple structure.

To attain the third object, according to a third aspect of the present invention, there is provided a resonance tube for use in a tone plate percussion instrument having at least one tone plate, comprising at least one resonance chamber that causes a musical tone generated by the tone plate to resonate therein, wherein the resonance chamber includes a first opening provided in communication with the resonance chamber, the first opening facing and opening toward the tone plate when the resonance tube is installed on the tone plate percussion instrument, and the resonance chamber further includes a second opening provided in communication with the resonance chamber, the second opening being located remote from the tone plate and opening in a direction away from the tone plate when the resonance tube is installed on the tone plate percussion instrument.

With this construction, it is possible to adjust the natural resonance frequency of the resonance chamber by varying the opening provided in the resonance chamber on the side opposite from the tone plate, thereby increasing the degree of freedom in designing the resonance tube.

To attain the third object, according to a third aspect of the present invention, there is provided a resonance box for use in a tone plate percussion instrument having a plurality of tone plates, comprising resonance chambers provided to correspond to respective ones of the plurality of tone plates, for causing musical tones generated by the plurality of tone plates to resonate therein, respectively, wherein each of the resonance chambers includes a first opening provided in communication therewith, the first opening facing and opening toward a corresponding one of the tone plates when the resonance box is installed on the tone plate percussion instrument, each resonance chamber further includes a second opening provided in communication therewith, the second opening being located remote from and opening in a direction away from the corresponding one of the tone plates, and the second openings of the resonance chambers are different in at least one of opening area and opening depth from one another, whereby each resonance chamber causes the musical tone of the specific tone pitch sounded by the corresponding one of the tone plates to resonate therein.

With this construction, it is possible to adjust the natural resonance frequency of each of the resonance chambers by varying the opening area and/or depth of the opening provided in the resonance chamber on the side thereof opposite from the tone plate, thereby enhancing the degree of freedom in designing the resonance box.

Preferably, the resonance chambers are substantially the same in shape and volume from one another.

With this construction, it is possible to achieve commonality of the resonance chambers between tone pitches to thereby reduce types of parts constituting the resonance chambers.

The above and other objects, features, and advantages of the invention will become more apparent from the following detailed description taken in conjunction with the accompanying drawings.

BRIEF DESCRIPTION OF THE DRAWINGS

FIG. is a left side view of a keyboard instrument constructed as a keyboard-type tone plate percussion instrument that includes a resonance box according to a first embodiment of the present invention;

FIGS. 20A through 20H are views showing various resonance tubes according to a seventh embodiment of the present invention, wherein:

FIG. 20A is a plan view of a resonance tube;

FIG. 20B is a front view of the resonance tube shown in FIG. 20A;

FIG. 20C is a plan view of another resonance tube;

FIG. 20D is a front view of the resonance tube shown in FIG. 20C;

FIG. 20E is a plan view showing still another resonance tube;

FIG. 20F is a front view of the resonance tube shown in FIG. 20E;

FIG. 20G is a plan view showing a further resonance tube;

FIG. 20H is a front view of the resonance tube shown in FIG. 20G;

DETAILED DESCRIPTION OF THE PREFERRED EMBODIMENTS

The present invention will now be described in detail below with reference to the drawings showing preferred embodiments thereof.

Figure 1:
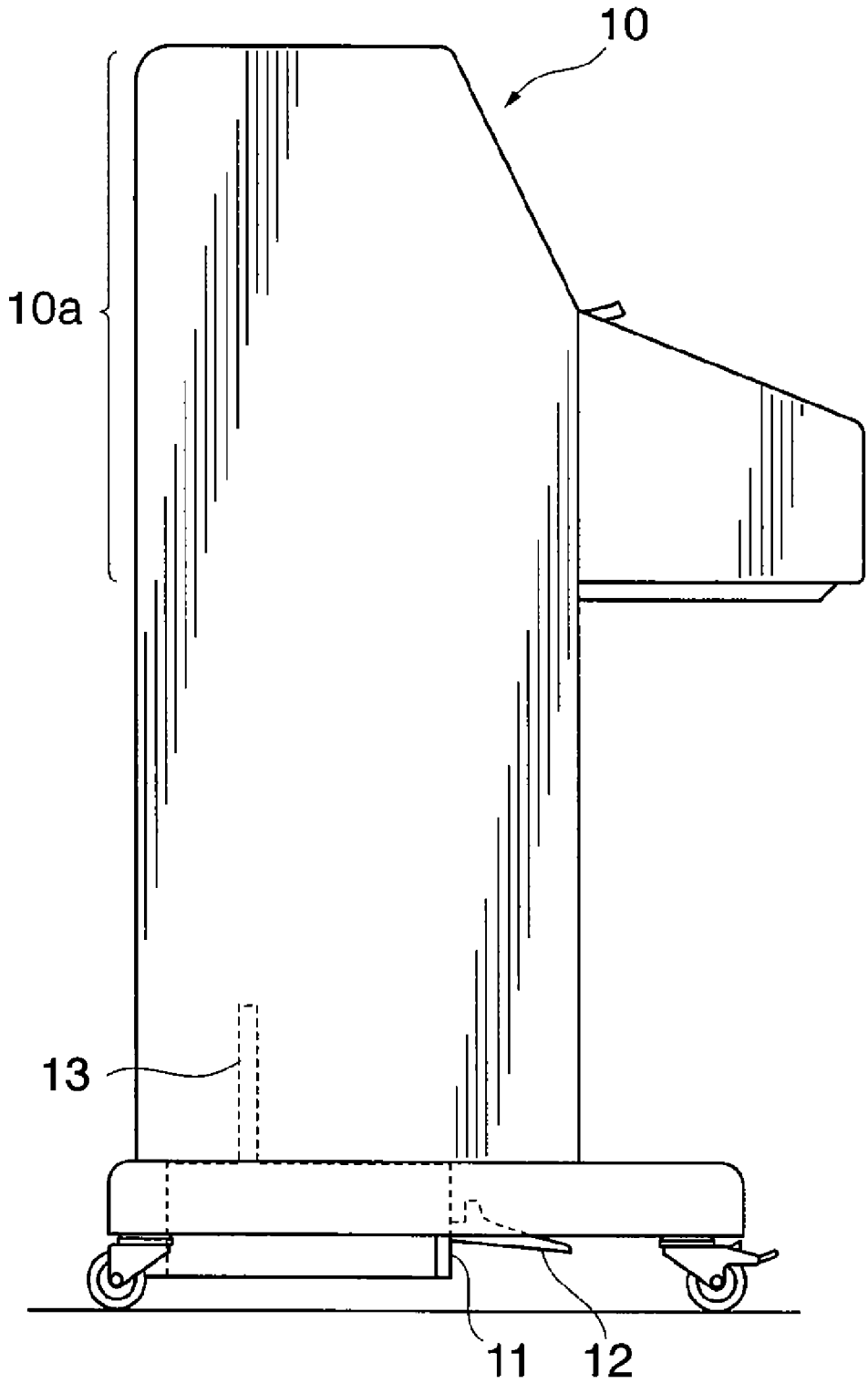

FIG. 1 is a left side view of a keyboard instrument that is constructed as a keyboard-type tone plate percussion instrument including a resonance box according to a first embodiment of the present invention. Roughly speaking, the keyboard instrument 10 is analogous in appearance to an upright piano, but does not include any strings. Instead, the keyboard instrument 10 includes tone plates that are similar to those of a celesta and provided in an upper half 10*a* of the keyboard instrument 10. When struck, each of the tone plates vibrates and generates a musical tone. The keyboard instrument 10 includes a resonance box that causes the musical tone generated by the corresponding tone plate to resonate therein. As mechanisms for striking the tone plates, there are provided mechanisms similar to action mechanisms for a grand piano but not for an upright piano.

In the following, the side of the keyboard instrument 10 toward a player will be referred to as the front side, and the left and right directions are determined in reference to the player. A pedal box 11 is provided in a lower part of the keyboard instrument 10, and a damper pedal 12 is extended forwardly from the pedal box 11.

The keyboard instrument 10 is analogous to a celesta in which tone plates formed into a flat plate are used as sounding members. A plurality of tone plates (mentioned later with reference to FIG. 5), which are sounding members in the present embodiment, are thick and formed into a rod rather than a plate. Thus, the term "tone plate" might not be appropriate. Nevertheless, since the term "tone plate" has commonly been used in the field of celesta, the sounding members used in the keyboard instrument 10 are referred to as the "tone plates 30." As will be described in detail later, the resonance chambers of the present embodiment are creative in shape to realize a single-stage structure of a tone plate group and a resonance box, while ensuring appropriate widths of the resonance chambers.

Figure 2:
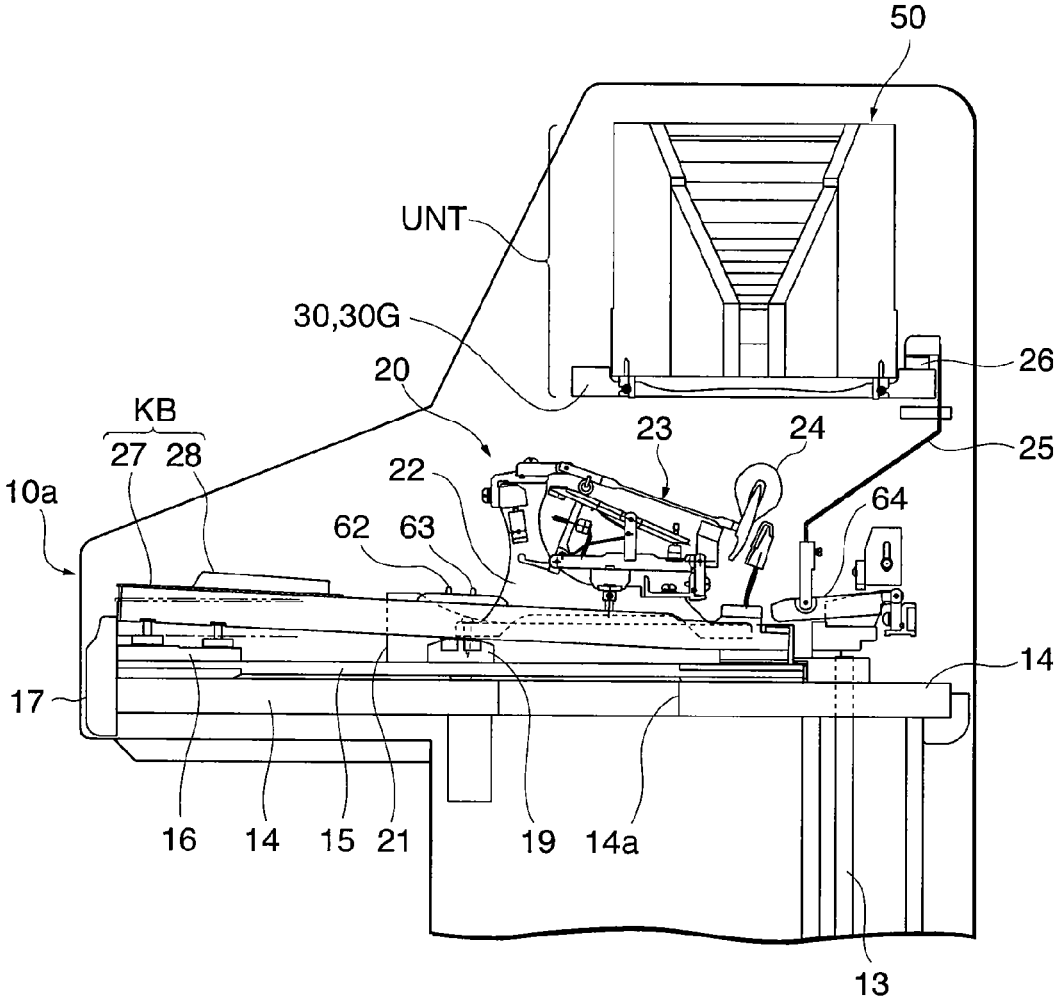
FIG. 2 is a right sectional view showing the internal construction of an upper half of the keyboard instrument.
Figure 3:
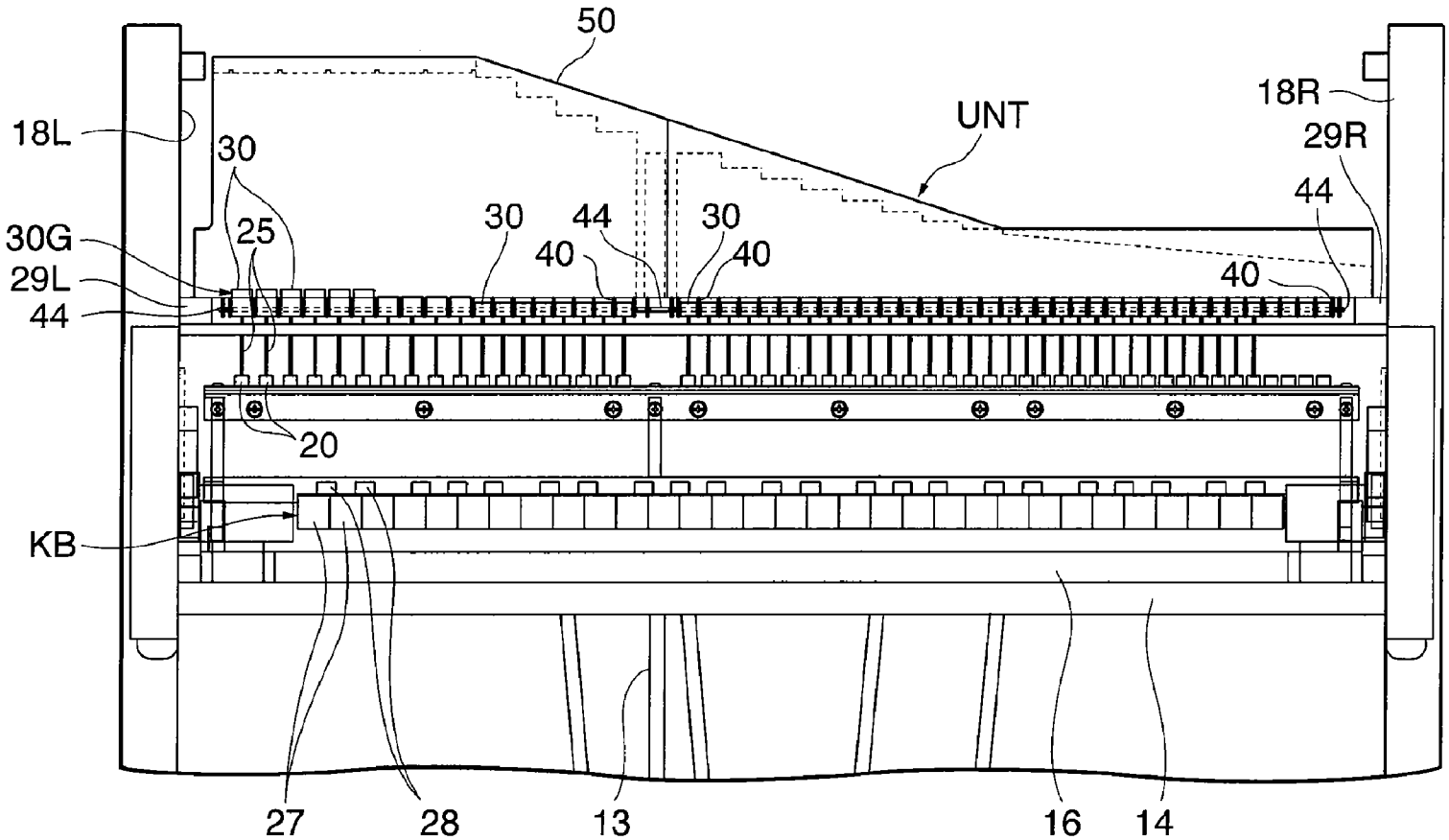
FIG. 3 is a front view showing the internal construction of the upper half of the keyboard instrument.
Figure 4:
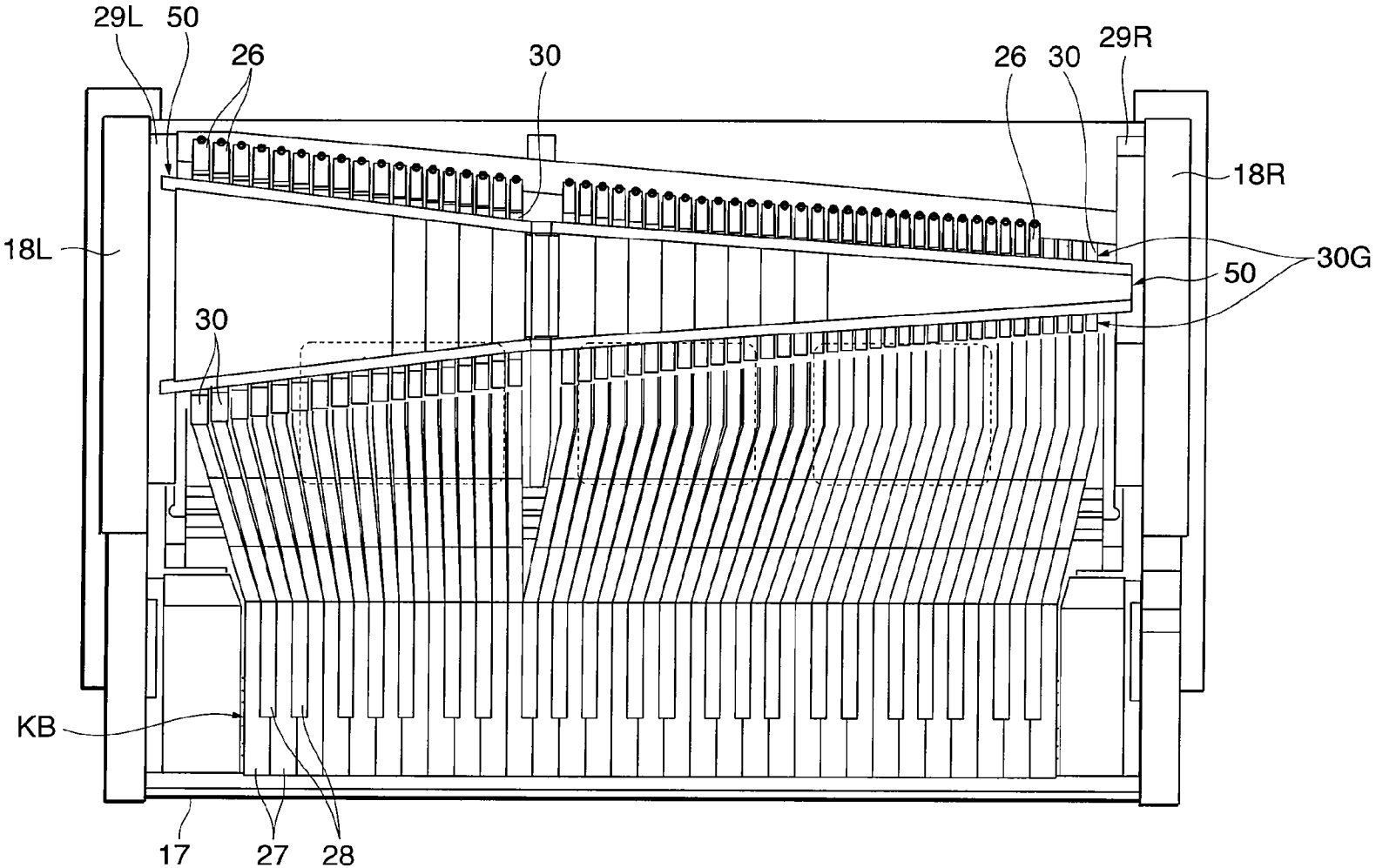
FIG. 4 is a plan view showing the internal construction of the upper half of the keyboard instrument.

FIG. 2 is a right side view showing the internal construction of the upper half 10*a* of the keyboard instrument 10, FIG. 3 is a front view showing the internal construction of the upper half 10*a*, and FIG. 4 is a plan view showing the internal construction of the upper half 10*a*.

As shown in FIG. 2, a key frame 15 is disposed on a keybed 14 which is provided in a lower part of the upper half 10*a* of the keyboard instrument 10, and a front rail 16 is formed on the front side of the key frame 15. The key frame 15 is provided with a balance rail 19 that supports a plurality of white keys 27 and a plurality of black keys 28 of a keyboard KB for vertical pivotal motion (seesaw motion) around respective ones of balance pins 62, 63 that are provided in the balance rail 19. A front portion of the front rail 16 is covered by a keyslip 17 over the entire width of the keys (also refer to FIG. 4). In FIG. 3, the illustration of the keyslip 17 is omitted.

Action mechanisms 20 are disposed through action brackets on an upper portion of a rear half of the key frame 15. The action brackets 22 and the action mechanisms 20 are arranged to correspond to respective ones of the keys 27, 28. The action mechanisms 20 are the same in construction as those of a grand piano. A tone generator unit UNT, including a wood resonance box 50 and a tone plate group 30G comprised of a plurality of tone plates 30, is disposed above the action mechanisms 20. The tone plates 30 are provided to correspond to respective ones of the keys 27, 28. When any one of the keys 27, 28 is depressed, a corresponding hammer 23 is pivoted upward and then a hammer felt 24 strikes a corresponding tone plate 30, which vibrates and generates a musical tone that resonates in the resonance box 50. The keybed 14 disposed below the action mechanisms 20 is formed with sound output ports 14*a*.

A plurality of pivotal members 64 are provided above rear ends of the keys 27, 28 so as to correspond to respective ones of the keys 27, 28, and damper felts 26 are provided on respective ones of damper wires 25 extending from the pivotal members 64 (refer to FIG. 3). When the damper pedal 12 is not stepped on, each of the damper felts 26 is in contact with the upper face of a rear end of the corresponding tone plate 30. When any one of the keys is depressed, the corresponding damper felt 26 is caused, via the damper wire 25, to be separated from the corresponding tone plate 30. A pedal coupling rod 13 is coupled to the damper pedal 12. When the damper pedal 12 is stepped on, all the damper felts 26 are lift up by means of the pedal coupling rod 13 and all the damper wires 25.

As shown in FIGS. 3 and 4, supporting portions 29L, 29R are fixed to inner sides of side plates 18L, 18R that constitute right and left sides of the keyboard instrument 10. As will be described later, the tone generator unit UNT is comprised of the resonance box 50 and the tone plate group 30G mounted for vibration thereto, which are formed into one piece. When mounted to and dismounted from the keyboard instrument 10, the tone generator unit is handled as an integrated piece. The resonance box 50 has its left and right sides fixed to the support portions 29L, 29R by means of screws, not shown, whereby the tone generator unit UNT is received in the upper half 10*a* of the keyboard instrument 10.

Figure 5A:
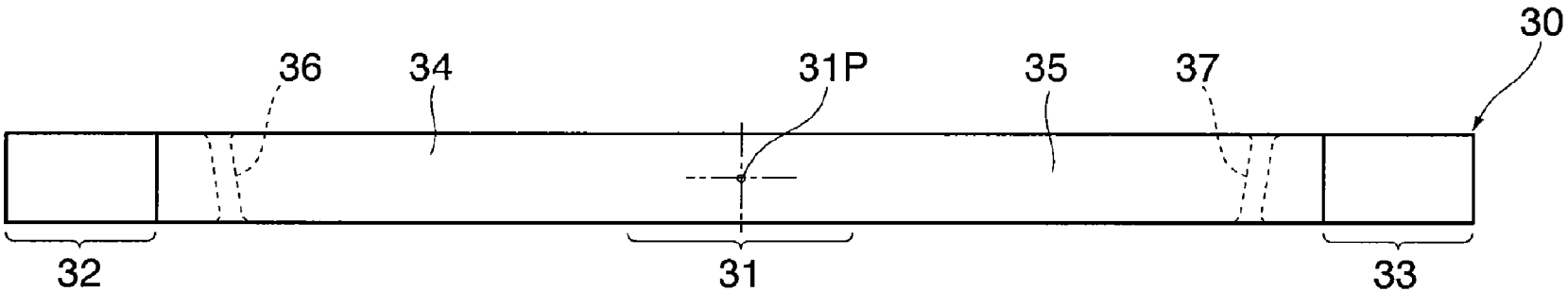
FIG. 5A is a plan view of a tone plate.
Figure 5B:
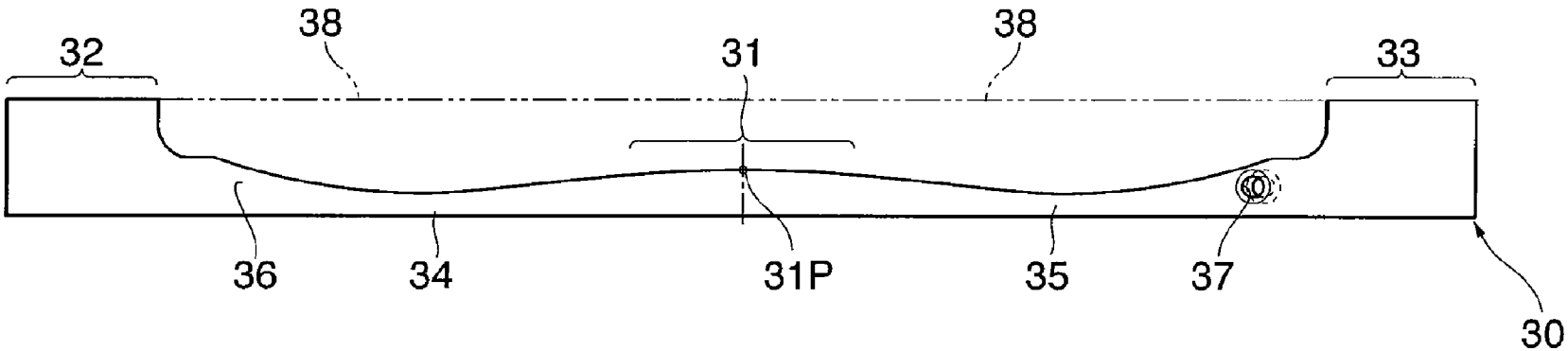
FIG. 5B is a right side view of the tone plate.
Figure 6:
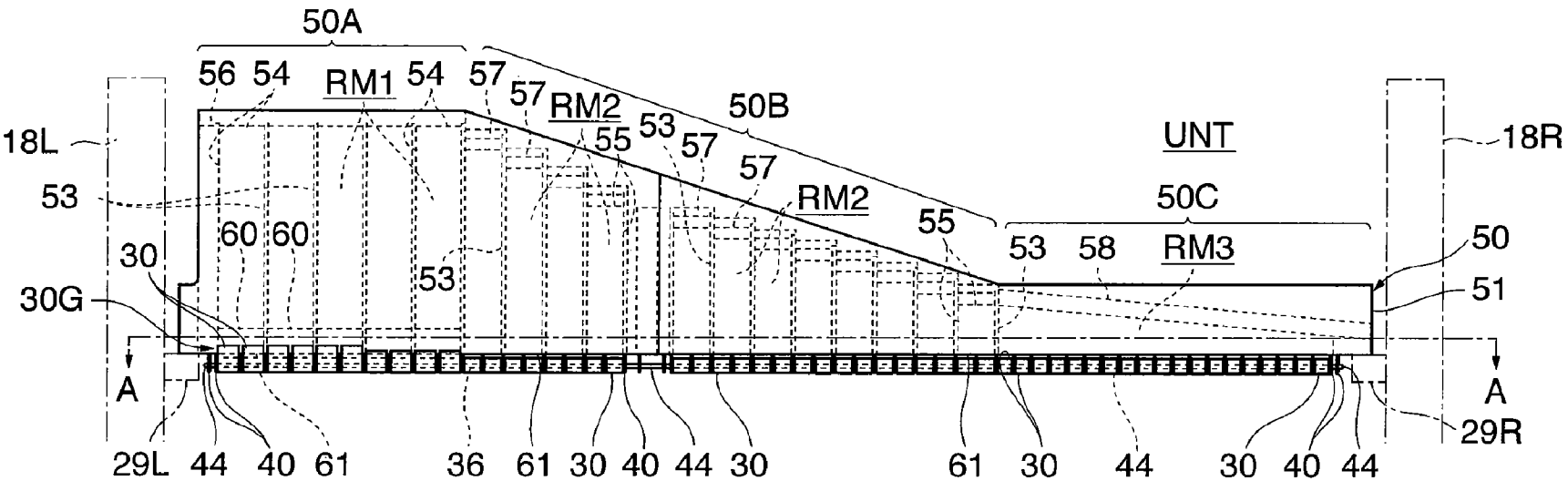
FIG. 6 is a front view of a tone generator unit.
Figure 7:
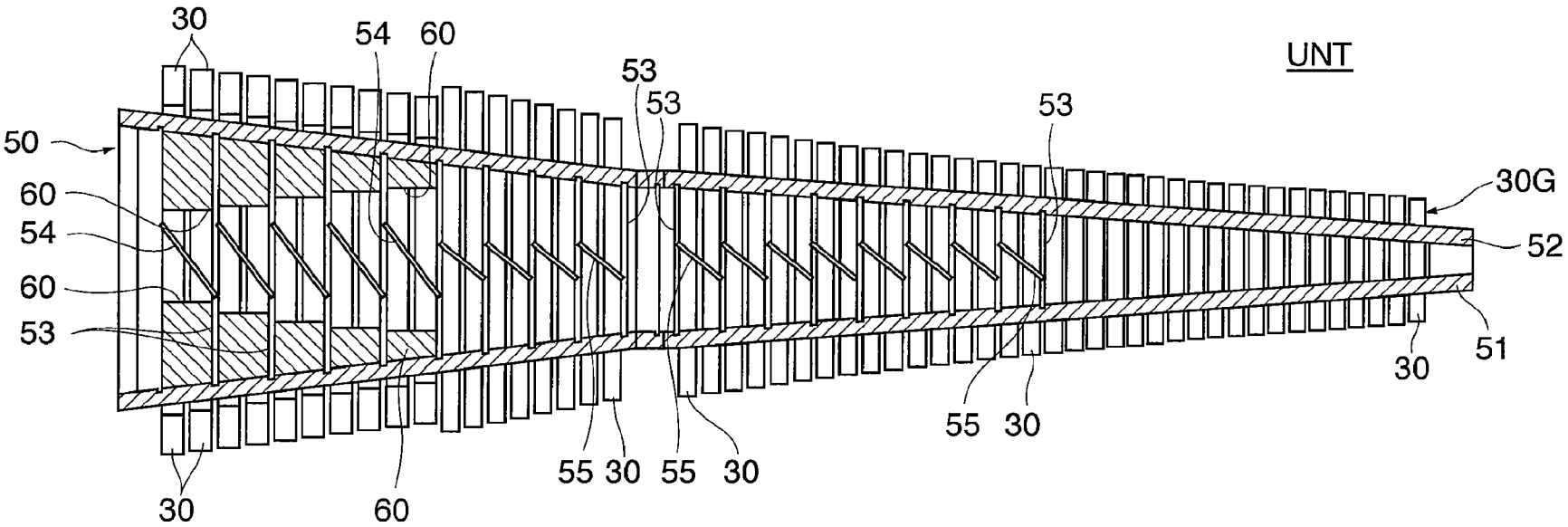
FIG. 7 is a section view taken along line A-A shown in FIG. 6.
Figure 8:
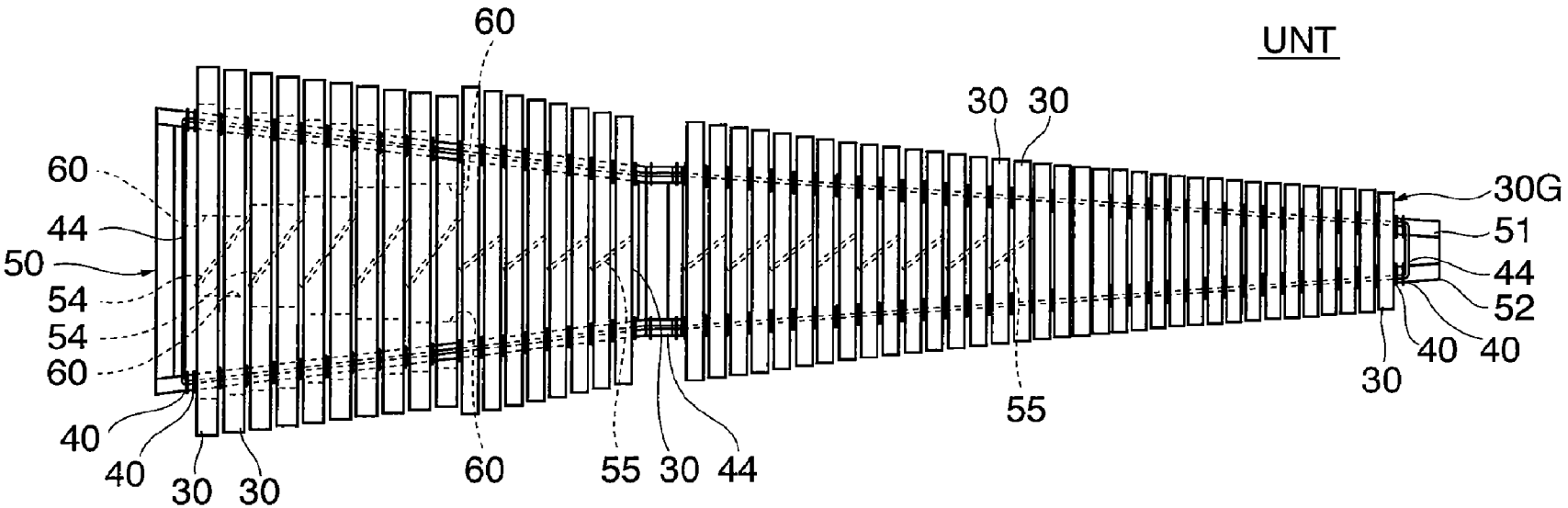
FIG. 8 is a bottom view of the tone generator unit.

Next, an explanation will be given of the construction of the tone generator unit UNT. FIG. 5A is a plan view of one tone plate 30, and FIG. 5B is a right side view of the tone plate 30. FIG. 6 is a front view of the tone generator unit UNT, FIG. 7 is a section view taken along line A-A in FIG. 6, and FIG. 8 is a bottom view of the tone generator unit UNT.

First, the tone plate group 30G will be explained. The tone plate group 30G is comprised of tone plates 30 that are equal in number to the keys. Each of the tone plates 30 vibrates when struck by the corresponding hammer felt 24 and generates a musical tone of a specific tone pitch. The tone plates 30 are different in shape such as the entire length or the like from one another (refer to FIGS. 7, 8 and 9C-9E), thereby generating musical tones having different specific pitches. The tone plates 30 constituting the tone plate group 30G are constructed into a single-stage structure, in which they are arranged in the order of tone pitch in the direction in which the keys are arranged and those tone plates 30 neighboring in specific pitch are arranged adjacent to each other (refer to FIGS. 3 and 6-8). It should be noted that the above-described action mechanisms 20 are also constructed into a single-stage structure where they are arranged to correspond to the array of the tone plates 30 in the direction in which the keys are arranged. In FIGS. 5A and 5B, there are shown tone plates 30 belonging to a low-pitch range portion 50A (mentioned later) of the resonance box 50.

As shown in FIGS. 5A and 5B, each of the tone plates 30 is formed with supporting holes 36 and 37, serving as first and second supported portions, at those positions of the tone plate which are closer to the front and rear ends (first and second ends) than to a longitudinally central portion and at which vibration nodes can be formed. The supporting holes 36, 37 are through holes through which a coupling cord 44 (refer to FIGS. 3, 6 and 8) extends. Among the tone plates 30, tone plates for a low tone pith range are disposed on the left side and made longer in entire length, and therefore the distances between their supporting holes 36, 37 are long in length. The supporting holes 36, 37 of each tone plate 30 extend in the width direction of the tone plate. Specifically, however, the supporting holes 36, 37 of each tone plate extend obliquely as seen from above such that they are closer to the front/rear side of the keyboard instrument 10 on the left side of the tone plate than on the right side, so as to be aligned with the supporting holes 36, 37 of the adjacent tone plates 30 (refer to FIG. 5A).

The supporting holes 36, 37 of each tone plate 30 are provided in positions at which vibration nodes can be formed, and therefore, the tone plate 30 effectively generates a musical tone when caused to vibrate in a state where the tone plate 30 is supported at the supporting holes 36, 37. A longitudinally central portion of the tone plate 30 is a portion where a vibration antinode can be formed (hereinafter referred to as the "antinode portion 31"). The center of the antinode portion 31 is located at a position corresponding to the antinode center of vibration (hereinafter referred to as the "antinode center 31P"). The tone plate 30 has its lower surface that is flat. The front and rear portions of the tone plate 30 project upward and are formed to be thick, whereby these portions constitute first and second mass concentrating portions 32, 33 on which the mass of the tone plate concentrates. The provision of the first and second mass concentrating portions 32, 33 makes it possible to shorten the entire length of the tone plate, in particular, the entire length of the tone plate belonging to the low tone pitch range.

As viewed in the vertical direction (thickness direction), the antinode portion 31 of the tone plate 30 is concave upward and made thinner than the first and second mass concentrating portions 32, 33. First and second thinner portions 34, 35 which are thinner in thickness than the antinode portion 31 are provided between the antinode portion 31 and the first mass concentrating portion 32 and between the antinode portion 31 and the second mass concentrating portion 33.

The resonance box 50 of the tone generator unit UNT is comprised of the low-pitch range portion 50A, a mid-pitch range portion 50B, and a high-pitch range portion 50C that are arranged in the mentioned order as seen from the low-pitch side (refer to FIG. 6). The tone plates 30 are not equal from one another in width measured in the right-to-left direction although those tone plates 30 belonging to the same pitch range portion have the same width. Specifically, the tone plates 30 corresponding to the low-pitch range portion 50A of the resonance box 50 are largest in width, whereas the tone plates 30 corresponding to the high-pitch range portion 50C is smallest in width.

The tone plates 30 are each made of a single material such as aluminum, aluminum allow, or steel, and formed into one piece. In fabricating the tone plate, an elongated member of a single material which is rectangular in cross section (an unmachined member 38 shown in FIG. 5B) may be machined from one direction (from above in the example shown in FIG. 5). Specifically, in machining, that portion of the unmachined member which extends from a position on the side close to the front end with respect to the supporting hole 36 to a position on the side close to the rear end with respect to the supporting hole 37 is removed from one direction by cutting and/or grinding the same, thereby forming the antinode portion 31, first and second mass concentrating portions 32, 33, and first and second thinner portions 34, 35.

Figure 9A:
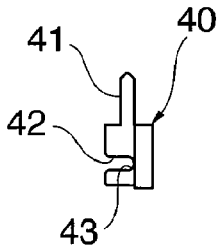
FIG. 9A is a side view showing a fastener for collectively holding a tone plate group.
Figure 9B:
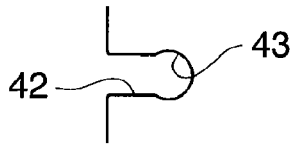
FIG. 9B is a fragmentary enlarged view of the fastener.
Figure 9C:
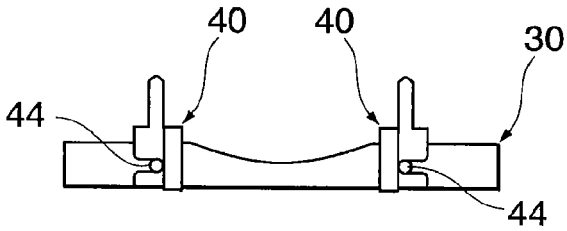
FIG. 9C is a side view showing tone plates corresponding to a high-pitch range, together with fasteners.
Figure 9D:
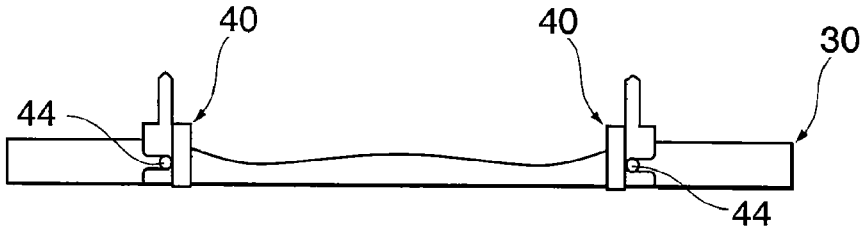
FIG. 9D is a side view showing tone plates corresponding to a mid-pitch range, and fasteners.
Figure 9E:
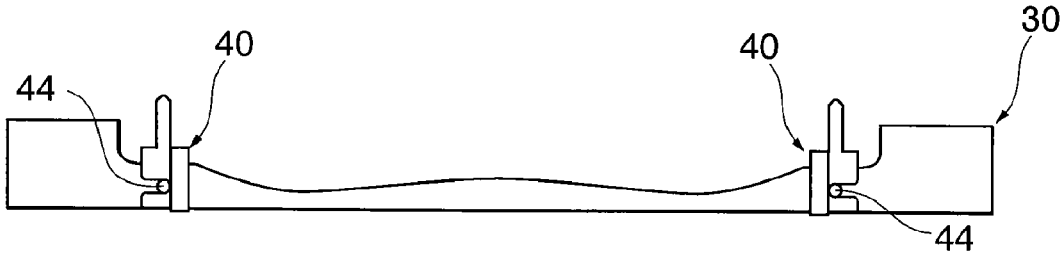
FIG. 9E is a side view showing tone plates corresponding to a low-pitch range, and fasteners.

FIG. 9A is a side view of one of fasteners 40 for collectively holding the tone plate group 30G, FIG. 9B is a fragmentary enlarged view showing the fastener 40, FIG. 9C is a side view showing a tone plate 30 corresponding to the high-pitch range portion 50C together with fasteners 40, FIG. 9D is a side view showing a tone plate 30 corresponding to the mid-pitch range portion 50B together with fasteners 40, and FIG. 9E is a side view showing a tone plate 30 corresponding to the low-pitch range portion 50A together with fasteners 40.

Generally in a celesta, tone plates for higher pitch sound may be shorter in length. As compared to tone plates 30 belonging to the low-pitch range portion 50A, tone plates 30 belonging to the mid- and high-pitch range portions 50B, 50C may be thinner in thickness of the first and second mass concentrating portions 32, 33 (refer to FIGS. 9C and 9D). Tone plates 30 belonging to the high-pitch range portion 50C are not formed with portions corresponding to the first and second thinner portions 34, 35 (refer to FIG. 9C).

The fastener 40 is made of metal or the like, and as shown in FIG. 9A, includes an engagement groove 42 adapted to be engaged with a coupling cord 44, and a pin 41 adapted to be pressed into the resonance box 50. The engagement groove 42 has a width slightly smaller than that of the coupling cord 44, and a cord receiving portion 43 that forms the back side of the engagement groove 42 is formed into a partial circle in cross-section having substantially the same diameter as that of the coupling cord 44 (refer to FIG. 9B). Thus, the coupling cord 44 can be inserted into the engagement groove 42 from the opening of the groove 42 and easily be brought in engagement with the cord receiving portion 43, while being prevented from being detached from the cord receiving portion 43 when the keyboard instrument 10 is in use for musical performance. All the fasteners 40 are formed into the same structure without distinguishing right-side use from left-side use, thereby preventing the number of types thereof from increasing.

In mounting the tone plate group 30G to the resonance box 50, the tone plates 30 forming the tone plate group 30G are first brought together using the coupling cord 44. For example, the tone plates 30 are arranged in the order of tone pitch, and the coupling cord 44 is inserted into the supporting holes 36, 37 of the tone plates 30 (the coupling cord 44 is looped counterclockwise from the lower left side of the tone plates 30 in the example shown in FIG. 8), and as a result the both ends of the coupling cords 44 are located on the left of the tone plate 30 on the lowest tone pitch side.

More specifically, the coupling cord 44 is sequentially inserted through the front supporting holes 36 of the tone plates 30 in the order of tone pitch from the front supporting hole 36 of the tone plate 30 for the lowest pitch. After inserted through the front supporting hole 36 of the tone plate 30 for the highest pitch, the coupling cord 44 is sequentially inserted through the rear supporting holes 37 of the tone plates 30 in the order of tone pitch from the rear supporting hole 37 of the tone plate 30 for the highest pitch. Finally, the both ends of the coupling cord 44 are tied together at a location on the left of the tone plate 30 for the lowest pitch. At any location the both ends of the coupling cord 44 may be tied together. Two or more cords may be used, which are tied together to form a single coupling cord 44.

As shown in FIGS. 7 and 8, the resonance box 50 has front and rear common wood walls 51, 52 that extend over substantially the entire length of the resonance box 50 in the direction in which the keys are arranged. The distance between the front and rear common walls 51, 52 is larger toward the side of the low pitch range of the resonance box 50. Thus, these common walls 51, 52 are arranged in an inverted V shape as seen from above and in the direction from left to right of the resonance box. The front and rear common walls 51, 52 each have a lower surface thereof formed with positioning holes, not shown, into which the pins 41 of the fasteners 40 can easily be fitted.

In order to mount the tone plate group 30, into which the tone plates 30 are tied together by the coupling cord 44, to the resonance box 50, the resonance box 50 is placed up side down, for example, and the pins 41 of the fasteners 40 are inserted into the positioning holes of the front and rear common walls 51, 52 of the resonance box 50 and then pressed into the positioning holes using a tool such as a hammer. The above operation is performed for all the fasteners. Subsequently, the tone plate group 30G is placed on the lower surfaces of the front and rear common walls 51, 52 of the resonance box 50, and the coupling cord 44 is engaged with the cord receiving portions 43 of the fasteners 40 at locations between the tone plates 30. Thereafter, the upside-down resonance box 50 is reversed to a normal state, whereby the tone plate group 30G is held by the resonance box 50 through the coupling cord 44 so as to be suspended therefrom, as shown in FIGS. 3 and 6. As a result, the tone generator unit UNT is constructed, in which the resonance box 50 and all the tone plates 30 are formed into one unit.

In the tone generator unit UNT, the antinode portions 31 of the tone plates 30 are disposed close to the openings formed in (the lower side of) corresponding ones of a plurality of resonance chambers (mentioned later) of the resonance box 50 so as to be capable of vibrating independently of one another. The distance between adjacent ones of the tone plates 30 is temporarily determined by the thickness of corresponding fasteners 40, and thus the pins 41 of the fasteners 40 can easily be positioned in alignment with the positioning holes, making it easy to perform the required operation. As shown in FIG. 8, the tone plate group 30G is divided into two groups in the direction in which the keys are arranged. At least one pair of front and rear positioning holes may be formed for each of these left and right groups, so that when the tone plates 30 are mounted to the resonance box 50, the distance between adjacent ones of the tone plates 30 may automatically be determined by the thickness of the fasteners concerned. It is not inevitably necessary to form the positioning holes in advance.

As shown in FIG. 6, the resonance box 50 is comprised of low-pitch, mid-pitch, and high-pitch range portions 50A, 50B and 50C that are different in type from one another. The low-pitch range portion 50A of the resonance box 50 is a Helmholtz type resonance box, in which there are provided resonance chambers RM1, which are the same in number as associated tone plates 30, so as to correspond to these tone plates 30. The mid-pitch range portion 50B is a closed-tube type resonance box, in which resonance chambers RM2 that are the same in number as associated tone plates 30 are provided so as to correspond to the tone plates 30. The resonance chambers RM1 and RM2 are referred to as the predetermined resonance chambers. The high-pitch range portion 50C is a single-type resonance box having a single resonance chamber RM3 that is common to associated tone plates 30.

As shown in FIG. 7, the front and rear common walls 51, 52 of the resonance box 50 are connected to each other by a plurality of partition plates (first plate members) 53 having different lengths. The partition plates 53 are made of a flat plate extending in parallel to one another in the longitudinal and vertical directions of the resonance chambers of the resonance box 50, and are extended from lower openings of respective ones of the resonance chambers to upper ends thereof as shown in FIG. 6. The partition plates 53 are fixed at their front and rear portions to the front and rear common walls 51, 52 by adhesive or the like.

As shown in FIG. 7, between respective adjacent ones of the partition plates 53 in each of the pitch range portions 50A, 50B and 50C, two tone plates 30 are provided in the direction of array of the keys. The distance between the adjacent partition plates 53 is made slightly larger than the total width of the corresponding two tone plates 30. In the low- and mid-pitch range portions 50A and 50B, adjacent ones of the partition plates 53 are connected to each other by inclined plates (second plate members) 54 and 55. Between the adjacent two partition plates 53, there are two resonance chambers RM1 formed by the inclined plate 54, and two resonance chambers RM2 formed by the inclined plate 55 (refer to FIG. 6). Thus, the partition plates 53 cooperate with the inclined plates 54, 55 to form "chamber-defining portions."

As shown in FIG. 6, a lid member 56 common to the low-pitch range portion 50A is fixed to upper ends of the partition members 53 for the low-pitch range portion 50A so that upper portions of all the resonance chambers RM1 are collectively closed. In the mid-pitch range portion 50B, there are lid members 57, one for two resonance chambers RM2, that are fixed to upper ends of the partition plates 53 so that upper portions of the resonance chambers RM2 are closed. Further, one lid member 58 common to the high-pitch range portion 50C is fixed to upper ends of the partition members 53 for the high pitch range portion 50C so that an upper portion of the resonance chamber RM3 is closed.

The inclined plates 54, 55 are each formed by a flat plate that extends in the vertical direction of the resonance box 50. The inclined plates 54 extend parallel to one another, and the inclined plates 55 also extend parallel to one another. Since the inclined plates 54, 55 are basically the same in construction and function from one another, the construction of the inclined plate 55 and the resonance chamber RM2 in the mid-pitch range portion 50B will mainly be explained in the following.

Figure 10:
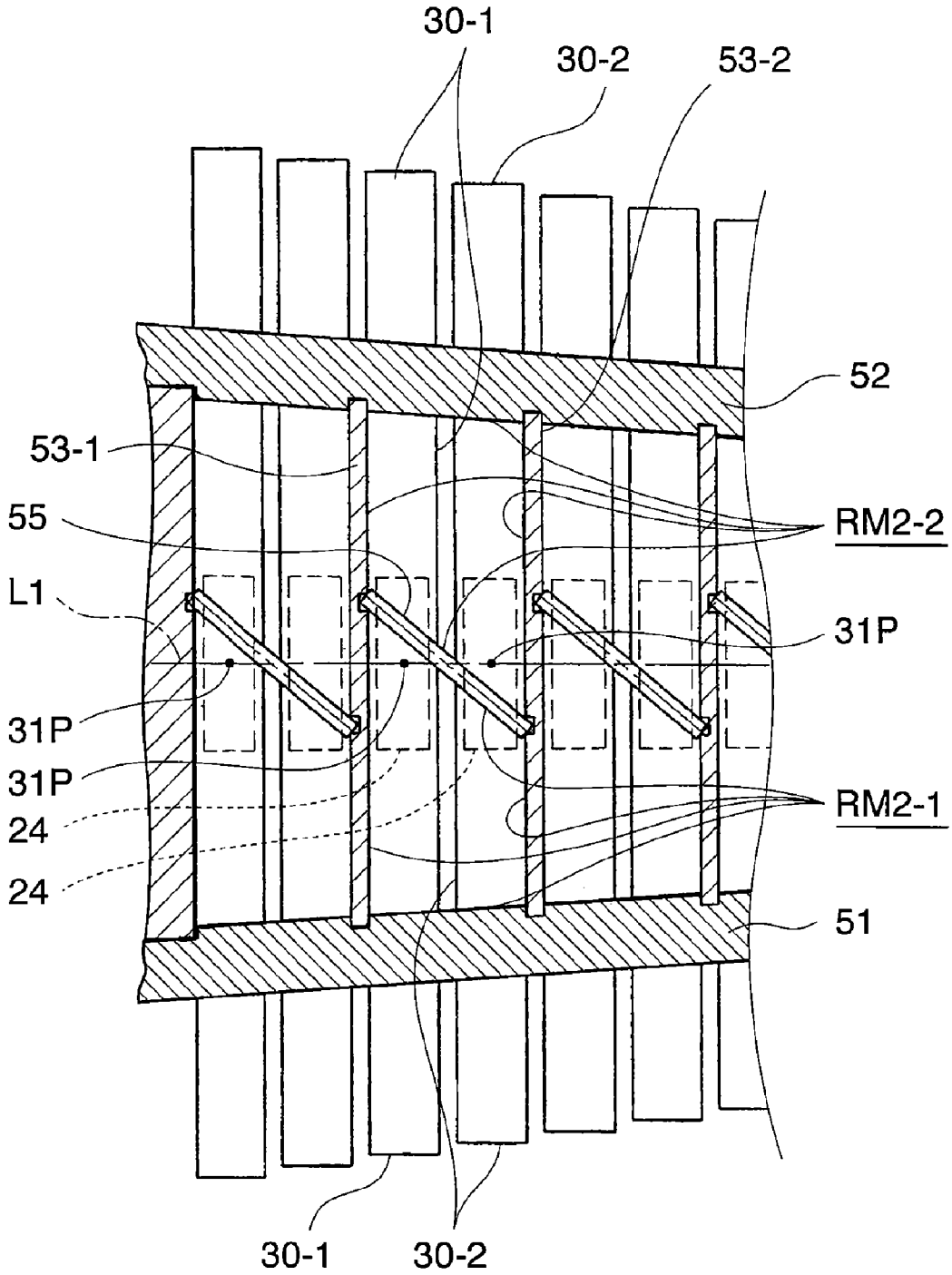
FIG. 10 is a fragmentary enlarged view showing a mid-pitch range portion of the tone generator unit shown in FIG. 7.

FIG. 10 is a fragmentary enlarged view showing the mid-pitch range portion 50B of the tone generator unit UNT shown in FIG. 7. Two resonance chambers RM2 are explained herein as a representative example, and for discrimination, suffix numeral 1 is attached to a respective one of the resonance chambers RM2, corresponding partition plates 53 and corresponding tone plates 30, whereas suffix numeral 2 is attached to a respective another of them. The inclined plate 55 connecting the two partition plates 53-1, 53-2 has both ends thereof respectively fixed by adhesive or the like to a portion of the partition plate 53-1 which is in the middle but close to the rear end of the plate 53-1 and a portion of the partition plate 53-2 which is in the middle but close to the front end of the plate 53-2 as viewed in the front-to-rear direction of these plates.

In the tone generator unit UNT, the center positions of the hammer felts 24 (refer to FIG. 2) are each in coincidence with the antinode center 31P (refer to FIGS. 5A and 5B) of the corresponding tone plate 30. The antinode centers 31P of all the tone plates 30 are the same in position in the front-to-rear direction, so that an imaginary straight line L1 shown in FIG. 10 passes through all the antinode centers 31P as seen in plan view. The straight line L1 also passes through regions of all the resonance chambers RM1, RM2, and RM3 as seen in plan view.

As shown in FIG. 10, the tone plates 30-1, 30-2 are disposed between the partition plates 53-1, 53-2. In a space defined between the partition plates 53-1 and 53-2, front and rear parts thereof on the front and rear sides with respect to the inclined plate 55 respectively correspond to the resonance chambers RM2-1 and RM2-2. As viewed in plan, the antinode center 31P of the tone plate 30-1 is included in the resonance chamber RM2-1, whereas the antinode center 31P of the tone plate 30-2 is included in the resonance chamber RM2-2. Thus, musical tones generated by the tone plates 30-1 and 30-2 respectively resonate in the resonance chambers RM2-1 and RM2-2 that are in one-to-one correspondence with the two tone plates. In this manner, the antinode centers 31P of all the tone plates 30 are each positioned within the corresponding resonance chamber RM.

In general, if too small in width, each resonance chamber of the resonance box cannot achieve a satisfactory resonance function. The resonance chambers RM2-1, RM2-2 of this embodiment are each ensured to have a sufficient width in the direction in which the keys are arranged, whereby satisfactory resonance can be realized. In addition, the tone plates 30 that are the same in number to the keys 27 and 28 are arranged within the same width as the total width of the keys in the direction of the array of these keys, and the total width of two tone plates 30 is enough to provide two resonance chambers RM2. As a result, unlike the prior art, it is unnecessary to divide the action mechanisms 20 and the tone plates 30 into two stages for the ordinarily-constructed keyboard KB, and thus they can be constructed into a single stage structure.

The inclined plate 54 in the low-pitch range portion 50A has basically the same construction as the inclined plate 55 in the mid-pitch range portion 50B although these inclined plates 54, 55 are different in angle of inclination and in length (refer to FIG. 7) due to the difference in tone plate width between the two pitch range portions 50A, 50B. As shown in FIGS. 6 and 7, a port-forming member 60 is provided in a lower portion of each resonance chamber RM1 in the low-pitch range portion 50A. At an opening of each resonance chamber RM1 (except for the resonance chamber RM1 on the left end), a port is formed by the two partition plates 53, the inclined plate 54, and the port-forming member 60. In a Helmholtz-type resonance box, a musical tone resonating therein has a tone pitch that is generally affected by the length and sectional area of the port as well as the volume of the resonance box. For example, the tone pitch at which a musical tone resonates in the resonance box decreases with the increase in port length and with the decrease in port sectional area even when the volume of the resonance box is kept unchanged. In the present embodiment, the port-forming member 60 is formed into a shape that is appropriately determined to thereby adjust the length and sectional area of the port of each resonance chamber RM1 so that a musical tone having a tone pitch determined by the corresponding tone plate 30 can satisfactorily resonate in the resonance chamber.

According to the present embodiment, the tone plates 30 belonging to the low-pitch range portion 50A are each provided with the first and second mass concentrating portions 32, 33 at its parts closer to the front and rear ends thereof with respect the supporting holes 36, 37, and the first and second thinner portions 34, 35 respectively extending between the antinode portion 31 and the first and second mass concentrating portions 32, 33, and are made of a single material (refer to FIGS. 5A and 5B). This makes it easy to shorten the entire length of the tone plate 30 and reduce the width thereof, thereby enhancing the degree of freedom in design. As a result, the keyboard instrument can be made compact in size, while covering a wide range. Since there is a general tendency that the tone plates for generating musical tones, especially those for generating low-pitch musical tones, have become larger in length, the tone plate 30 shown in FIGS. 5A and 5B is suitable for generation of low-pitch musical tones.

The tone plates 30 can easily be fabricated by removing, from one direction, that part of an unmachined member 38 which is on one side of the unmachined member as viewed in the thickness direction, wherein the unmachined member 38 is an elongated member that is rectangular in cross section and made of a single material. Thus, it is easy to fabricate the tone plates 30 and make the tone plates 30 for generating different tone pitches have the same width. In the tone generation unit UNT, the number of types of tone plate width can be reduced to three.

According to the present embodiment, moreover, the plurality of tone plates 30 are each mounted for vibration to the resonance box 50 at a location close to the opening of the corresponding resonance chamber of the resonance box 50, whereby the resonance box 50 and the tone plates 30 are unified into the tone generation unit UNT. Thus, it is easy to replace the tone generation unit UNT by a new tone generation unit where an appropriate positional relation is also retained between the resonance box 50 and the tone plates 30. For example, replacement to a new tone generation unit that is different in construction of tone plates and/or resonance box makes it possible to easily change tone colors even in the acoustic tone plate percussion instrument. In addition, such easy replacement of tone generation units UNT makes it easy to perform maintenance of the tone plate group 30G and/or the resonance box 50.

Moreover, the plurality of tone plates 30 are collectively held for vibration by the coupling cord 44, and the coupling cord 44 is mounted to the resonance box 50 by means of the plurality of fasteners 40. In particular, the tone plates 30 are made thick at locations where vibration nodes are formed, which makes it possible to form the supporting holes 36, 37 in the tone plates 30 so as not to extend in the vertical direction but extend in the direction in which the keys are arranged. Since the supporting holes 36, 37 extend in the direction of array of the keys, the tone plates 30 constituting the tone plate group 30G can be held collectively by the coupling cord 44 in a state where they are suspended from the resonance box 50. This makes it possible to collectively handle the tone plate group 30G and collectively mount and dismount the tone plate group 30G to and from the resonance box 50 for ease of mounting and replacement the tone plates 30. Since the supporting holes 36 and 3 are formed in the tone plates 30 at locations where vibration nodes are formed, these holes do not hinder the tone plates from performing satisfactory sounding.

In mounting the tone plates 30, the distance between adjacent ones of the tone plates 30 is temporarily fixed by the fasteners 40. This makes it easier to mount and replace the tone plates 30.

It is not inevitably necessary to form the supporting holes 36, 37 in the form of through holes so long as the plurality of tone plates can be collectively held by a cord member such as the coupling cord 44. For example, each of these supporting holes may be a groove which is formed into a partial circle in cross section and opens to the lower surface of the tone plate 30. From the view point of achieving the function of collectively holding the plurality of tone plates, the cord used therefor is not necessarily be limited to the coupling cord 44. It should be noted that it is not inevitably necessary to collectively hold all the tone plates, but the tone plate group 30G may be divided into two groups or more, and each of the divided tone plate groups may be held together.

According to the present embodiment, the resonance chambers RM1, RM2 for the low- and mid-pitch range portions 50A, 50B are each ensured to have a sufficient width in the direction of array of the keys, which is equal to or wider than the total width of corresponding two tone plates 30, thereby making it possible to achieve satisfactory resonance. In addition, the resonance chambers RM1, RM2 are so defined as to overlap each other as viewed from front, whereby the resonance box 50 can be constructed to have a shortened length in the direction of array of the keys, while ensuring an appropriate width of each resonance chamber. As a result, the tone plate group 30G and the resonance box 5 of the entire keyboard instrument can be constructed into a single-stage structure.

The keyboard instrument is constructed that the imaginary straight line L1 passes through all the resonance //chambers RM1, RM2, and RM3, and the antinode centers 31P (refer to FIGS. 5A and 5B) of all the tone plates 30 are at the same position as viewed in the front-to-rear direction of the keyboard instrument, thereby making it possible to unify operation feelings between all the tone plates 30 and make the tone plate group 30G compact in size in the longitudinal direction of the tone plates 30.

The resonance chambers RM1, RM2 are defined by the plurality of partition plates 53 through which the front and rear common walls 51, 52 are connected and the inclined plates 54, 55 through which adjacent ones of the partition plates 53 are connected, whereby these resonance chambers can be defined with a simple construction and can be fabricated with ease since in particular the plurality of partition plates 53 extend parallel to one another.

Moreover, unlike the conventional upper and lower two-stage structure, the present embodiment, in which the tone plate group 30G and the resonance box 50 of the entire keyboard instrument can have a single-stage structure, does not require a long coupling rod for transmitting a key-depressing operation to a lower group of percussion units. The single-stage structure is simple in construction and can easily be made light in weight. The tone plates 30 corresponding to the white keys 27 and the tone plates 30 corresponding to the black keys 28 are the same in vertical position, making it easy to balance sounds from the tone plates corresponding to the white and black keys. Furthermore, unlike the upper and lower two-stage structure, sounds output from tone plates 30 are not interrupted by the lower tone plate group, lower percussion unit group, and lower resonance box. Thus, the resultant instrument is simple in construction and light in weight and capable of easily unifying key-operation feelings and of efficiently outputting well-balanced sounds. Besides, the sound output ports 14*a* are formed in the keybed 14 below the action mechanisms 20, and therefore the tone plates 30 can output sounds directly to the outside, thereby enhancing the sound output efficiency.

Figure 11:
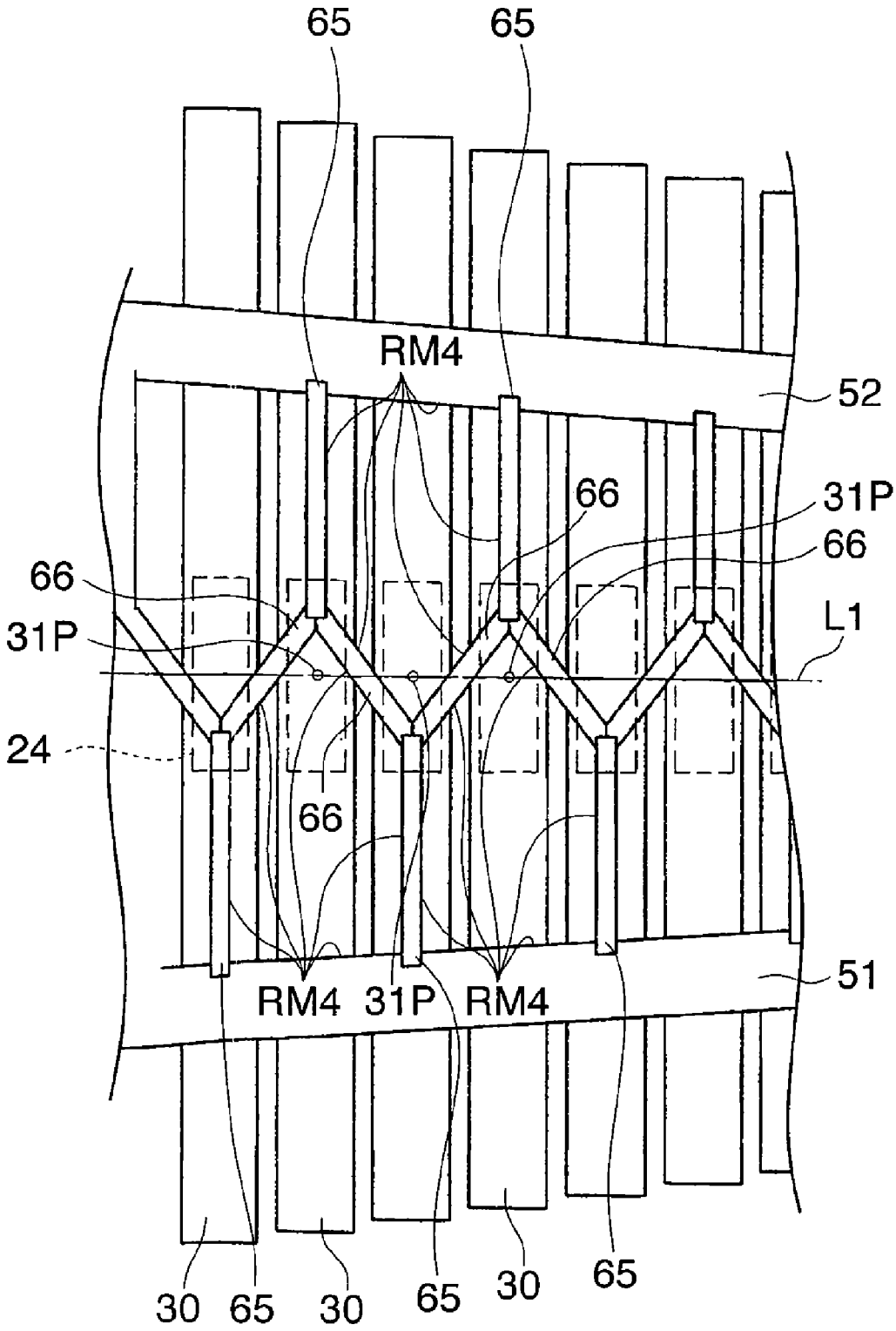
FIG. 11 is a fragmentary enlarged view showing a mid-pitch range portion of a resonance box in a keyboard-type tone plate percussion instrument that includes a resonance box according to a second embodiment of the present invention.

In the following, a second embodiment of the present invention will be explained. As compared to the first embodiment, the second embodiment differs in the construction of the resonance box 50 of the tone generator unit UNT, but is the same in other respects. FIG. 11 which is similar to FIG. 10 is a fragmentary enlarged view showing a mid-pitch range portion of the resonance box in a keyboard-type tone plate percussion instrument including the resonance box according to the present embodiment.

In the first embodiment, the plurality of partition plates 53 in the low- and mid-pitch range portions 50A, 50B are each connected at its both ends with the front and rear common walls 51, 52. On the contrary, in the second embodiment, there are provided a plurality of partition plates (first plate members) 65 whose length is as large as about the half of the length of the partition plates 53. These partition plates 65 are connected at their one ends with either the first or second common wall 51 or 52, as shown in FIG. 11. In other respects, the partition plates 65 are the same in construction as the partition plates 53.

In the first embodiment, adjacent ones of the partition plates 53 are connected to each other by the inclined plates 54, 55. In the second embodiment, closely arranged two partition plates 65 in the low- and mid-pitch range portions 50A, 50B have other ends (which are not connected to either the front or rear common wall 51 or 52) thereof connected to each other through an inclined plate (second plate member) 66, as shown in FIG. 11. A single resonance chamber RM4, which is referred to as the predetermined resonance chamber, is formed by adjacent two partition plates 65 and two inclined plated 66 connected to the other ends of these two partition plates 65. In other words, the partition plates 65 cooperate with the inclined plates 66 to constitute the "chamber-forming portion."

Also in the resonance box 50 shown in FIG. 11, the antinode centers 31P of all the tone plates 30 are the same in position as viewed in the front-to-rear direction (refer to FIGS. 5A and 5B), and an imaginary straight line L1 passing through all the antinode centers 31P also passes through regions of all the resonance chambers RM4 as seen in plan view. In the low- and mid-pitch range portions 50A, 50B, each resonance chamber RM4 overlaps the adjacent resonance chambers RM4 and is ensured to have a sufficient width in the direction of array of the keys, which is equal to or larger than the total width of corresponding two tone plates 30.

According to the present embodiment, effects which are the same as those attained by the first embodiment can be attained. Furthermore, the antinode center 31P of each of the tone plates 30 is positioned at the center of the corresponding resonance chamber RM4 in the direction of array of the keys, and therefore, the second embodiment is more advantageous than the first embodiment in achieving satisfactory resonance.

In order to only ensure an appropriate width of each resonance chamber in the low- and mid-pitch range portions 50A, 50B to realize satisfactory resonance as well as to realize a single-stage structure of the tone plate group and the resonance box for the entire musical instrument, it is enough if the following conditions are satisfied. Specifically, each of the plurality of resonance chambers must overlap another resonance chamber as seen in plan view, and the maximum width of each resonance chamber in the direction in which the tone plates are arranged must be equal to or larger than the total width of two tone plates corresponding thereto. The type of a material to construct respective portions of the resonance box 50 is not limited to wood. For example, the partition plates and the inclined plates disposed between the front and rear common walls may be made of a resin and may integrally be formed so as to construct the plurality of resonance chambers. Furthermore, the partition plates and the inclined plates may be formed integrally with the front and rear common walls 51, 52 into meshes each of which constitutes one resonance chamber.

In the following, modifications of the resonance box are shown, each of which may be adopted, if necessary, although they are inferior in effect to the first and second embodiments. FIGS. 12A to 12D are fragmentary views showing the modifications of the resonance box.

Figure 12A:
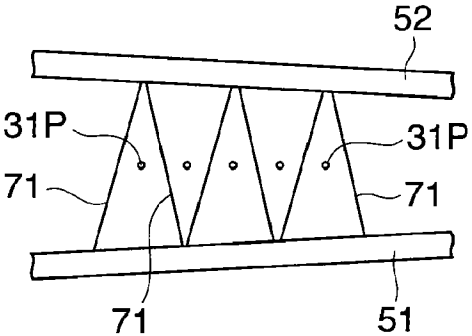
FIG. 12A is a fragmentary section view showing a first modification of the resonance box.

As shown by way of example in FIG. 12A, inclined partition plates 71 may be disposed between the front and rear common walls 51, 52 so that one resonance chamber is formed between adjacent two of the partition plates 71, with apex portions of the resonance chambers alternately appearing on the front common wall and on the rear common wall. In this modification, the partition plates 71 constitute the "chamber-forming portions."

Figure 12B:
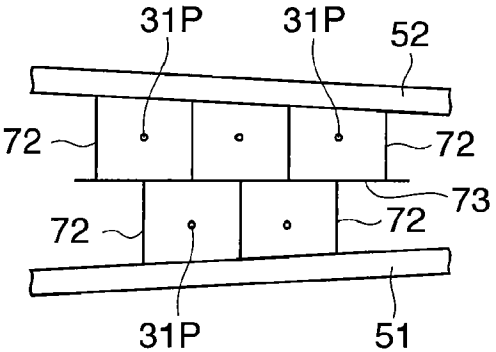
FIG. 12B is a fragmentary section view showing a second modification of the resonance box.
Figure 12C:
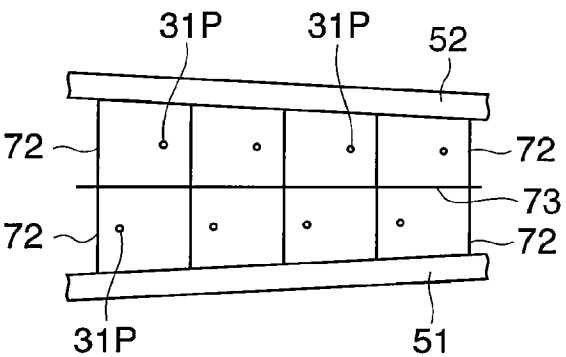
FIG. 12C is a fragmentary section view showing a third modification of the resonance box.

As shown in FIGS. 12B and 12C, a plate member 73 may be disposed between the front and rear common walls 51, 52 so as to extend in the direction of array of the keys, and a plurality of partition plates 72 each connecting the plate member 73 and the front or rear common wall 51 or 52 may be provided, so that there are formed resonance chambers of a two-stage structure as seen in the front-to-rear direction.

Figure 12D:
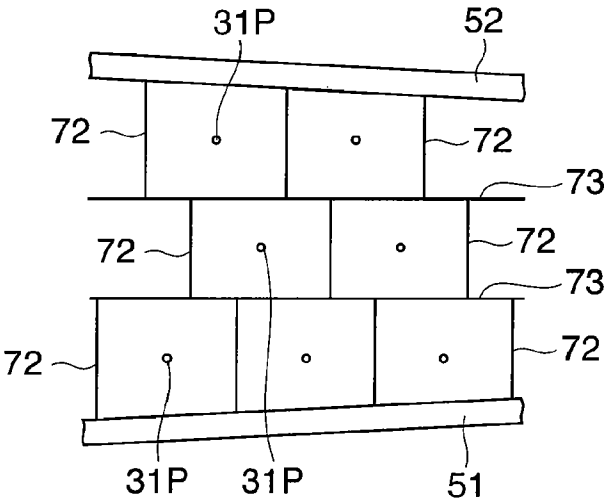
FIG. 12D is a fragmentary section view showing a fourth modification of the resonance box.

As shown in FIG. 12D, there may be provided two plate members 73 between the front and rear common walls 51, 52 as well as a plurality of partition plates 72 each connecting the two plates members 73 with each other, connecting the front-side plate member 73 with the front common wall 51, or connecting the rear-side plate member 73 with the rear common wall 52, so as to construct a resonance chamber of a three-stage structure as seen in the front-to-rear direction. Of course, the number of stages in the front-to-rear direction is not limited two or three. In the modifications shown in FIGS. 12B to 12D, the partition plates 72 and the plate members 73 constitute the "chamber-forming portions."

It should be noted that the modification shown in FIG. 12A where the partition plates 71 do not extend parallel to one another has a disadvantage that the ease of fabrication is lowered. The modifications shown in FIGS. 12B to 12D are disadvantageous in that the antinode centers 31P of the tone plates 30 cannot have the same position in the front-to-rear direction.

In the following, a third embodiment of the present invention will be explained. In the third embodiment, the keyboard KB and the action mechanisms 20 are made variable in position in the direction of array of the keys with respect to the tone generator unit UNT. The third embodiment is the same (including the tone generator unit UNT) in construction as the first embodiment, expect for mechanisms for making the keyboard KB and the action mechanisms 20 movable.

Figure 13:
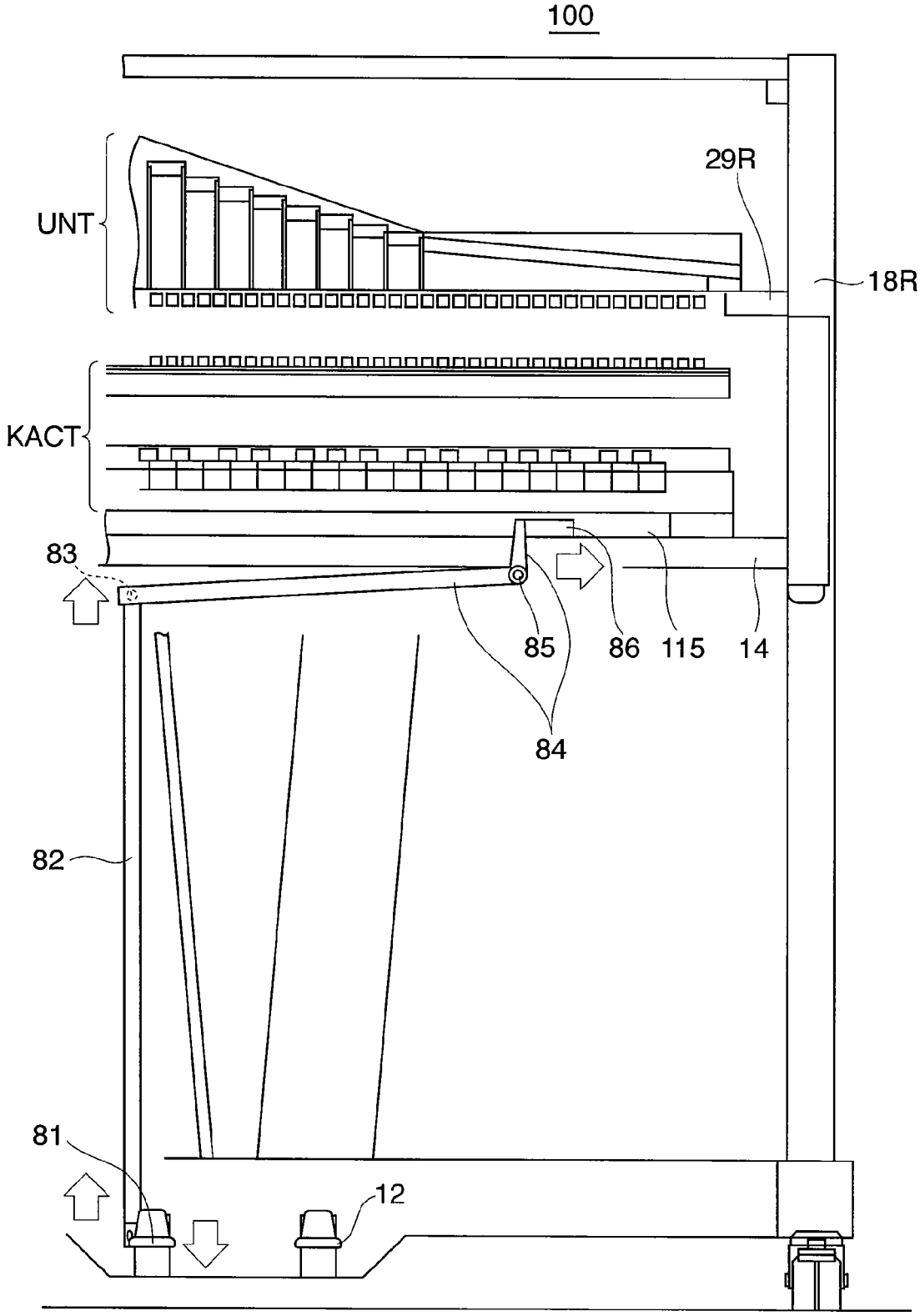
FIG. 13 is a front view showing the internal construction of a keyboard instrument constructed as a keyboard-type tone plate percussion instrument that includes a resonance box according to a third embodiment of the present invention.

FIG. 13 is a front view showing the internal construction of a keyboard instrument constructed as a keyboard-type tone plate percussion instrument that includes a resonance box according to the present embodiment, and mainly shows the right half of the keyboard instrument. In the keyboard instrument 100, a support 115 is disposed on a keybed 14, and a keyboard action unit KACT comprised of the keyboard KB and the action mechanisms 2 is disposed on the support 115. The support 115 is constructed to be movable in the left-to-right direction as in the case of a grand piano in which the support is moved in the left-to-right direction (the direction of array of the keys) in response to a shift pedal operation. A movable amount of the support 115 is set to an extent enough to permit key transposition (for example, an amount of five degrees).

In addition to the damper pedal 12, a key transposition pedal 81 is provided in a lower portion of the keyboard instrument 100. A coupling rod 82 is coupled to the key transposition pedal 81. An L-shaped link 84 is provided for clockwise pivotal motion around a pivot shaft 85 that is provided in the main body of the keyboard instrument 100. One end of the L-shaped link 84 is coupled to the coupling rod 82 for pivotal motion around a pivot shaft 83. Further, a pressing member 86 for driving the support 115 in the left-to-right direction is provided in the vicinity of a right side of the support 115. The support is always urged toward the left by means of an urging member such as a spring, not shown, which is provided in a side plate 18R, and another end of the L-shaped link 84 is in contact with the pressing member 86.

Although not illustrated, the tone generator unit UNT is provided with the tone plates 30 that are larger in number than the total number of the white and black keys 27, 28 in the keyboard action unit KACT so as to correspond to the tone generation range that varies according to key transposition range.

In the above construction, when the key transposition pedal 81 is stepped on, the coupling rod 82 is moved upward to rotate the L-shaped link 84 clockwise in FIG. 13, thereby urging the pressing member 86 to the right. As a result, the pressing member 86 causes the support 115 to slide/move to the right against the aforementioned urging member, not shown. At this time, the keyboard action unit KACT is moved in unison with the support 115. Since the tone generator unit UNT is fixed in position via supporting portions 29L, 29R relative to side plates 18L, 18R, there occurs a shift in the relationship between the tone plates 30 in the tone generator unit UNT and the action mechanisms 20 in the keyboard action unit KACT. As a result, the same effect as key transposition can be attained. On the other hand, when the key transposition pedal 81 is released, the keyboard action unit KACT is returned to the original position in unison with the support 115, and hence the original key is resumed.

According to the present embodiment, the key transposition can be made in the percussion instrument that acoustically generates sounds, making it possible to provide a variety in performance form. Since the keyboard KB and the action mechanisms 20 are moved together, a mechanism for shift alteration in a grand piano can be applied, making it possible to carry out the key transposition with a simple construction. Besides, satisfactory resonance of a musical tone generated by each tone plate 30 can still be attained since the correspondence relationship between the tone plates 30 and the resonance chambers is fixed.

To permit the key transposition, it is enough to construct the keyboard action unit KACT and the tone generator unit UNT so that the relative position therebetween can be varied. Instead of the keyboard action unit KACT, the tone generator unit UNT may be constructed for sliding motion.

In the present embodiment, as the operating member for driving the pressing member 86, a foot-operated member such as the key transposition pedal 81 is used, but this is not limitative. A hand-operated member may be used. The direction of key transposition in the embodiment is a direction to raise the key, but this is not limitative. Key transposition may be made in a direction in which the key is lowered.

Next, a fourth embodiment of this invention will be explained. Unlike the third embodiment where the key transposition state is sustainable only when the key transposition pedal 81 is being stepped on, the fourth embodiment is so designed that the key transposition state can be maintained. To this end, the fourth embodiment is provided with a mechanism for key transposition different from that of the third embodiment, whereas the construction of the tone generator unit UNT, the keyboard action unit KACT, and the like is the same as that of the third embodiment.

Figure 14B:
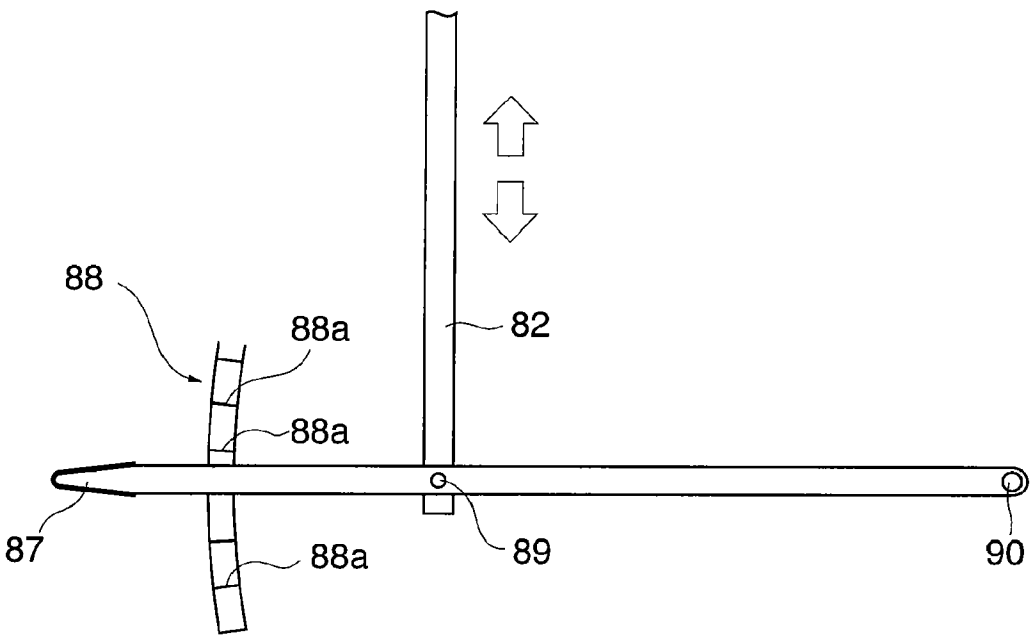
FIG. 14B is an inner side view showing a left side plate of the keyboard instrument.
Figure 14A:
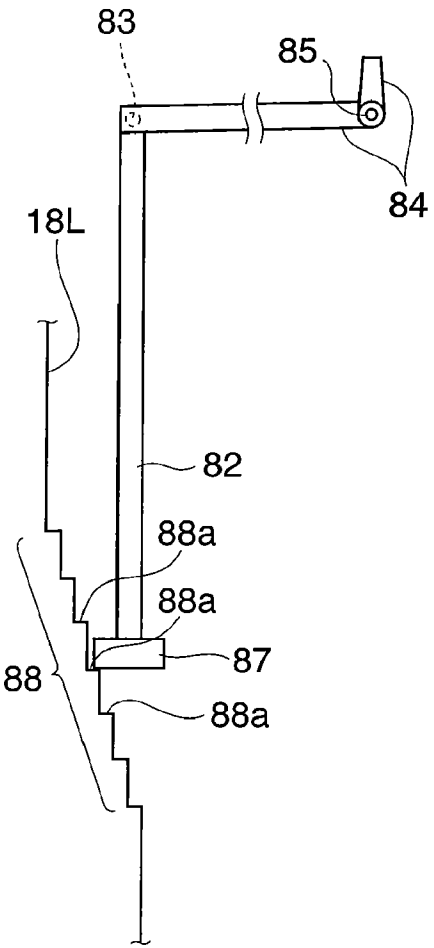
FIG. 14A is a front view showing a mechanism for key transposition in a keyboard instrument constructed as a keyboard-type tone plate percussion instrument that includes a resonance box according to a fourth embodiment of the present invention.

FIG. 14A is a front view showing a mechanism for key transposition in a keyboard instrument constructed as a keyboard-type tone plate percussion instrument that includes a resonance box according to the fourth embodiment. In FIG. 14A, the left side of the keyboard instrument is shown. FIG. 14B is an inner side view showing a left side plate of the keyboard instrument.

In the mechanism for key transposition, the coupling rod 82, pivot shaft 83, L-shaped link 84, pivot shaft 86, and support 115 have the same construction as those of the third embodiment except for their shapes and lengths. As shown in FIGS. 14A and 14B, on an inner side surface (right side surface) of the side plate 18L, there is provided a hand-operated lever 87 for pivotal motion around a pivot shaft 90. The lever 87 has its intermediate portion that is coupled to a lower end of the coupling rod 82 so as to be pivotable around a pivot shaft 89.

Further, a stepped positioning stopper portion 88 is formed in the inner side surface (right side surface) of the side plate 18. The stopper portion 88 is formed into a circular shape, as seen in side view, extending in the direction in which the lever 87 is pivoted (refer to FIG. 14B), and is comprised of a plurality of steps 88*a*. The distance between vertically adjacent ones of the steps 88*a* corresponds to a distance required for half-tone transposition.

With the above construction, a user grasps the lever 87 by hand and changes the step 88*a* to which the lever 87 is to be engaged, where required. For example, when the lever 87 is brought in engagement with the next upper step 88*a*, the pressing member 86 is urged to the right through the coupling rod 82 and the L-shaped link 84, so that the support 115 is slidingly moved to the right for an amount corresponding to half-tone. To lower the key, it is enough to engage the lever 87 with a lower step 88*a*.

According to the present embodiment, the same advantages as those attained by the third embodiment can be attained. In addition, key transpositions in both the directions to raise and lower the key can be made, and the resultant key transposition state can be maintained even after the player releases the lever 87.

The key transposition mechanism may be constructed to have both the mechanism of the third embodiment that performs key transposition only when the transposition pedal 81 is ON and the mechanism of the fourth embodiment that maintains the key transposition state.

Figure 15:
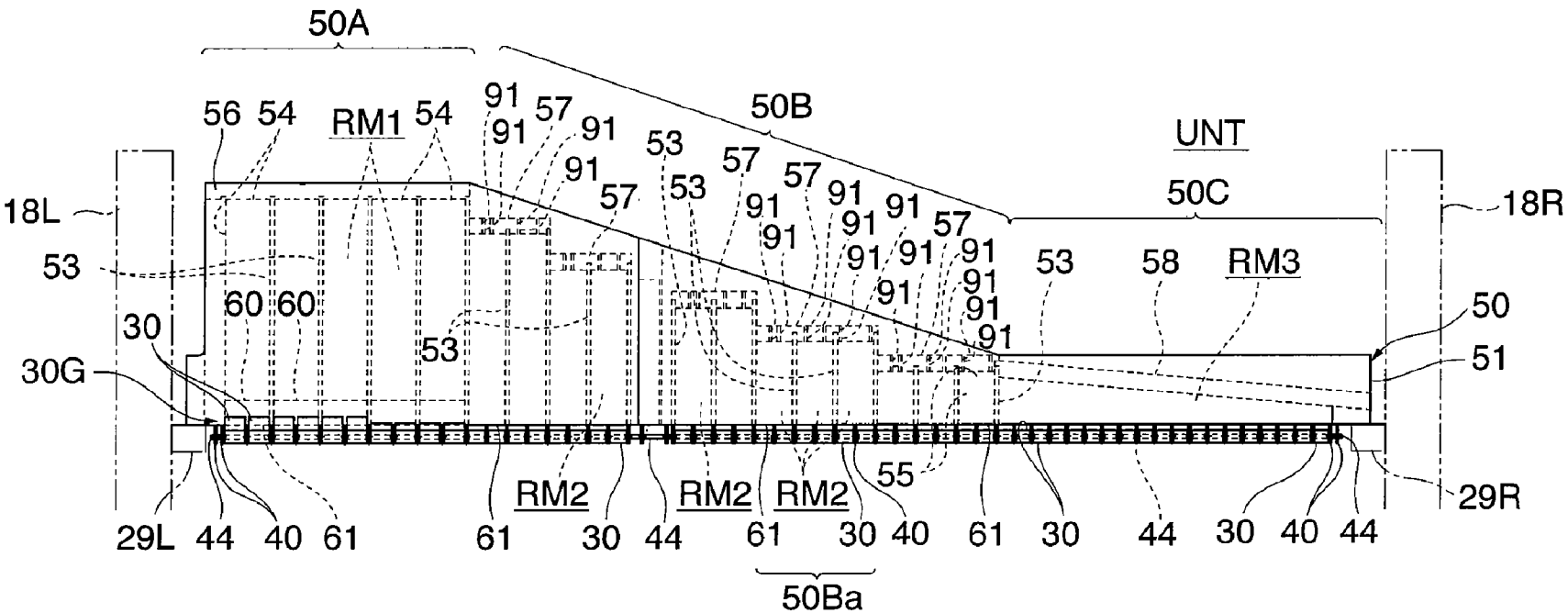
FIG. 15 is a front view showing a tone generator unit in a keyboard instrument to which is applied a resonance box according to a fifth embodiment of the present invention.

In the following, a fifth embodiment of the present invention will be explained. FIG. 15 is a front view showing a tone generator unit in a keyboard instrument to which is applied a resonance box according to the fifth embodiment, and FIG. 16 is a plan view showing the tone generator unit.

The present embodiment differs in construction of the resonance box from but is the same in other constructions as the first embodiment. Specifically, the present embodiment is the same as the first embodiment in the construction to receive the tone generator unit UNT in the upper half 10*a* of the keyboard instrument 10, the construction and arrangement of the plurality of tone plates 30, and the construction to mount the tone plates 30 to the resonance box 50 using the coupling cord 44 and fasteners 40, wherein the tone plates 30 are suspended for vibration from the resonance box 50.

The resonance box 50 of the tone generator unit UNT is comprised of low-pitch, mid-pitch, and high-pitch range portions 50A, 50B and 50C that are different in type from one another (refer to FIG. 15). The low-pitch range portion 50A is a Helmholtz type resonance box including resonance chambers RM1 that are the same in number as associated tone plates 30 so as to correspond to respective ones of these tone plates 30. The mid-pitch range portion 50B is a semi-closed tube type resonance box (the meaning of the term "semi-closed tube type" will be explained with reference to FIG. 17), in which resonance chambers RM2 that are the same in number as associated tone plates 30 are provided so as to correspond to respective ones of the tone plates 30. The high-pitch range portion 50C is a single-type resonance box having a single resonance chamber RM3 that is common to the tone plates 30 associated therewith.

Figure 16:
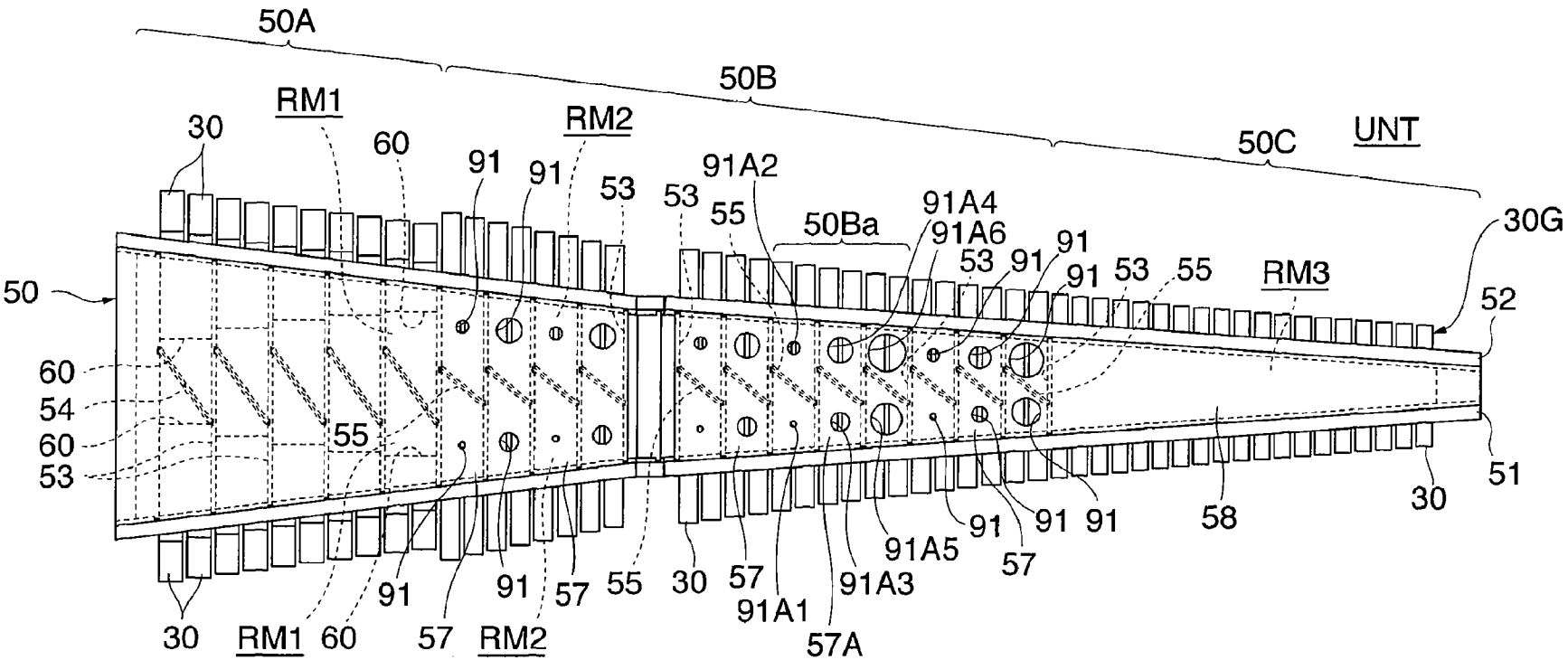
FIG. 16 is a plan view showing the tone generator unit.

As shown in FIG. 16, front and rear common walls 51, 52 of the resonance box 50 are connected to each other by a plurality of partition plates 53 having different lengths. The partition plates 53 are comprised of flat plates extending parallel to one another in the front-to-rear direction and vertical direction of resonance chambers of the resonance box 50, and are extended from lower openings (first openings) 61 to upper ends of respective ones of the resonance chambers, as shown in FIG. 15. The partition plates 53 are fixed at their front and rear portions to the front and rear common walls 51, 52 by adhesive or the like.

As shown in FIG. 16, between adjacent ones of the partition plates 53 in each of the low- and mid-pitch range portions 50A and 50B, there are provided two corresponding tone plates 30 as seen in the direction of array of the keys. Further, adjacent ones of the partition plates 53 are connected to each other by inclined plates 54, 55. Between the adjacent two partition plates 53, there are formed two resonance chambers RM1 by the inclined plate 54 and two resonance chambers RM2 by the inclined plate 55.

As shown in FIG. 15, a lid member 56 common to the low-pitch range portion 50A is fixed to upper ends of the partition members 53 and upper ends of inner stepped portions of the front and rear common walls 51, 52 in the low-pitch range portion 50A so that upper portions of all the resonance chambers RM1 are collectively closed. Further, one lid member 58 common to the high-pitch range portion 50C is fixed to upper ends of inner stepped portions of the front and rear common walls 51, 52 in the high pitch range portion 50C so that an upper portion of the resonance chamber RM3 is closed.

The mid-pitch range portion 50B is divided into five blocks between which there is a difference in heights of the partition plates 53 and the resonance chambers RM2. In the mid-pitch range portion 50B, there are provided lid members 57, one for each block, that are fixed to upper ends of the partition plates 53 and upper ends of inner stepped portions of the front and rear common walls 51, 52 so that upper portions of respective ones of resonance chambers RM2 are closed. It should be noted that each lid member 57 is formed with through holes (second openings) 91 so as to communicate with corresponding resonance chambers RM2, wherein the diameter of each through hole varies in accordance with to which of the resonance chamber RM2 the through hole corresponds. In other words, the resonance chambers RM2 are not closed. Thus, the mid-pitch range portion 50B is not referred to as the closed-tube type but to the "semi-closed tube type" as in the above explanation.

The basic construction of the resonance chambers RM is the same as that of the first embodiment having been described above with reference to FIG. 10.

As will be described below, the mid-pitch range portion 50B is so constructed that the resonance chambers RM2 have respective natural resonance frequencies not only by having the volumes of these resonance chambers to be set individually but also by having the opening areas of the through holes 91, which are formed on the side opposite from the tone plates 30, to be set individually.

Figure 17A:
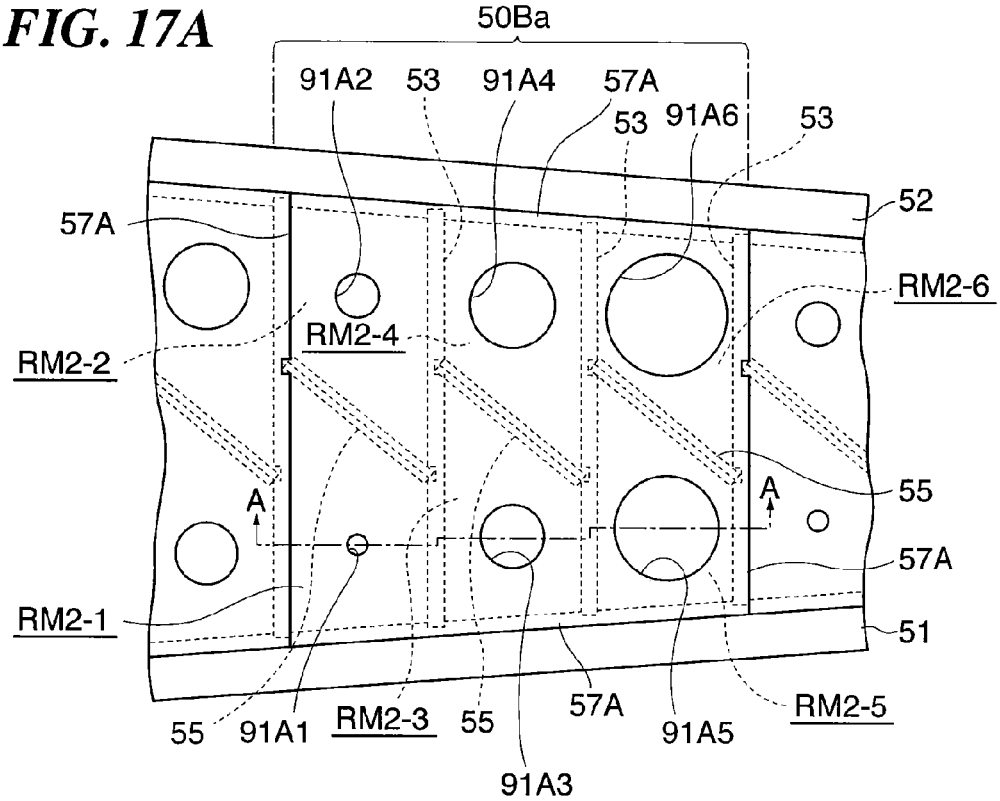
FIG. 17A is a fragmentary plan view showing a mid-pitch range portion of the tone generator unit.
Figure 17B:
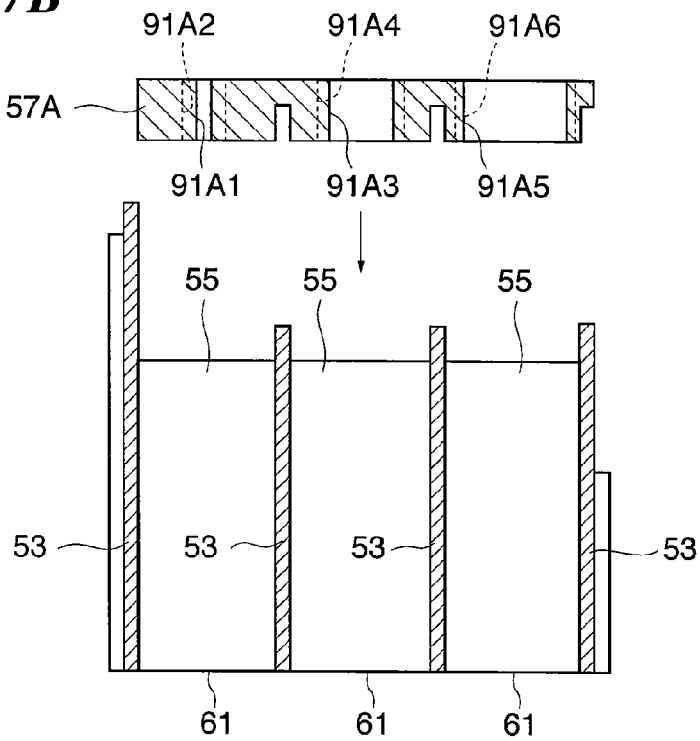
FIG. 17B is a section view taken along line A-A in FIG. 17A.

FIG. 17A is a fragmentary plan view showing the mid-pitch range portion of the tone generator unit UNT, and FIG. 17B is a section view taken along line A-A in FIG. 17A. Among the five blocks of the mid-pitch range portion 50B (refer to FIG. 15), the second highest pitch block 50Ba is shown in FIG. 17A. For clarity of explanation, the through holes 91 only for the block 50Ba are denoted by reference numerals 91A1 to 91A6 in FIGS. 16, 17A, and 17B to distinguish these holes from one another. The term "lid member 57A" is used to indicate the lid member 57 for the block 50Ba in order to distinguish it from the other lid members 57.

As shown in FIG. 17A, the through holes 91A1 to 91A6 are formed in the lid member 57A at locations corresponding to respective ones of upper portions of six resonance chambers RM2 (RM2-1 to RM2-6) in the block 50Ba. As shown in FIG. 17B, the lid member 57A has an uniform thickness over the entirety thereof, and the through holes 91A1 to 91A6 have the same depth (vertical length).

According to the present assignor's investigation, as parameters affecting natural resonance frequencies of the resonance chambers RM2, i.e., tone pitches allowed to resonate in the resonance chambers RM2, there are present not only the volumes of the resonance chambers RM2 but also the diameters (opening areas) and depths of the through holes 91. The investigation clarifies that, to allow a higher frequency to resonate in the resonance chamber, it is necessary to set the opening areas of through holes 91 formed in the resonance chamber on the side opposite from the corresponding tone plate 30 to be large and set the depth of the through hole 91 to be shallow. It should be noted that the resonance frequency of the resonance chamber RM2 can be made higher by decreasing the volume of the resonance chamber RM2.

In the present embodiment where the through holes 91 have the same depth, each resonance chambers RM2 is constructed to have an appropriate resonance frequency, which coincides with a specific tone pitch generated by the corresponding tone plate 30, by selectively determining a combination of the volume of the resonance chamber RM2 and the diameter of the through holes 91.

As shown by way of example in FIG. 17A, the resonance chambers RM2-1 and RM2-2 are the same in volume. The through hole 91A2 corresponding to the resonance chamber RM2-2 is larger in opening area than the through hole 91A1 corresponding to the resonance chamber RM2-1. Although these two resonance chambers have the same volume, the resonance frequency of the resonance chamber RM2-2 is higher than that of the resonance chamber RM2-1. The same relationship is applied to the resonance chambers RM2-3, RM2-4 and to the resonance chambers RM2-5, RM2-6.

To fabricate the tone generator unit UNT, the partition plates 53 are first fixed by adhesive or the like to the front and rear common walls 51, 52, and the inclined plates 54, 55 are fixed by adhesive or the like between adjacent ones of the partition plates 53. The lid members 56 to 58, including the lid member 57 in which the desired through holes 91 are formed beforehand, are fixed from above by adhesive or the like to the partition plates 53, front and rear common walls 51, 52, and the like. The desired through holes 91 may be formed in the lid member 57 after this lid member is adhered and fixed to the partition plates and the like.

Figure 18:
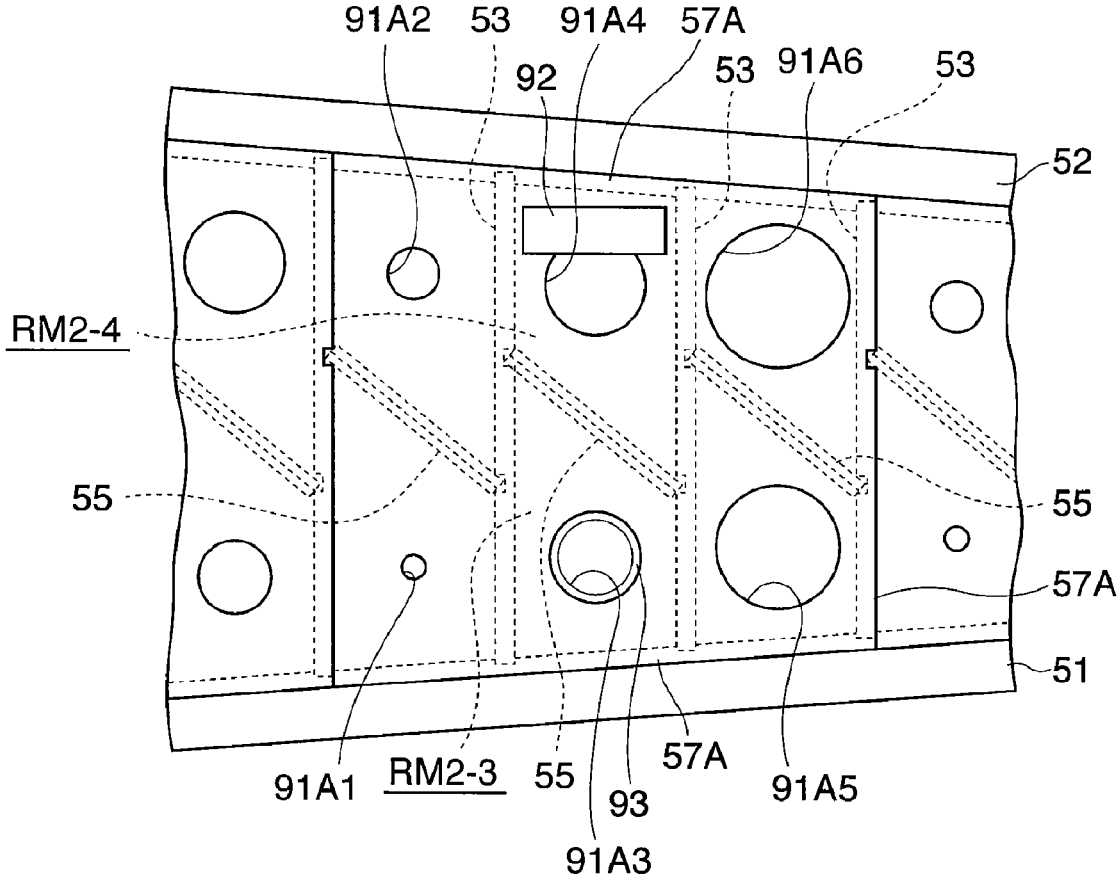
FIG. 18 is a fragmentary plan view showing a mid-pitch range portion of the tone generator unit.

FIG. 18 is a fragmentary plan view showing the mid-pitch range portion 50B of the tone generator unit UNT. The lid members are made of wood, for example, and the through holes are formed using a drilling tool such as a drill. At this time, if the resonance frequency is deviated from the target frequency, a minute adjustment is made as follows:

When the resonance frequency of the resonance chamber RM2-3 is lower than the target frequency, a chamfer 93 is formed in an upper portion of the through hole 91A3, as shown by way of example in FIG. 18. As a result, the depth of the through hole 91A3 is made shallower, and hence the resonance frequency of the resonance chamber RM2-3 is made higher. When the resonance frequency of the resonance chamber RM2-4 is higher than the target frequency, a plate piece is fixed to the lid member 57A so as to cover a part of the through hole 91A4. As a result, the opening area of the through hole 91A4 is made smaller, and hence the resonance frequency of the resonance chamber RM2-4 is made lower.

As explained above, the minute adjustment of the resonance frequency can individually be made for respective ones of the resonance chambers RM2 with ease, making it possible to easily set more appropriate resonance frequency.

According to the present embodiment, the mid-pitch range portion 50B of the tone generator unit UNT is constructed that the through holes 91 located on the side remote from the corresponding tone plates 30 are provided to communicate with the corresponding resonance chambers RM2, and the opening area of each through hole 91 is appropriately set, whereby musical tones sounded by the corresponding tone plates 30 and each having a specific tone pitch are allowed to resonate in respective ones of the resonance chambers. With this construction, the natural resonance frequency of each resonance chamber RM2 can be adjusted by variably setting the opening area of the corresponding through holes 91, thereby enhancing the degree of freedom in designing the resonance box 50.

Furthermore, the semi-closed tube type construction having the resonance chambers RM2 formed with the through holes 91 makes it possible for musical tones to easily travel upward, resulting in an advantage of improved sounds.

The present invention is also applicable to a construction in which resonance chambers RM are arranged in parallel to the array of the tone plates 30.

A sixth embodiment of the present invention will be explained. In the fifth embodiment, the front and rear common walls 51, 52 are arranged in an inverted V shape (refer to FIG. 16 and the like), and those resonance chambers RM which are adjacent to each other in the left-to-right direction are different in volume. On the contrary, in the sixth embodiment, a plurality of resonance chambers RM arranged in the left-to-right direction are the same in shape and volume from one another.

Figure 19A:
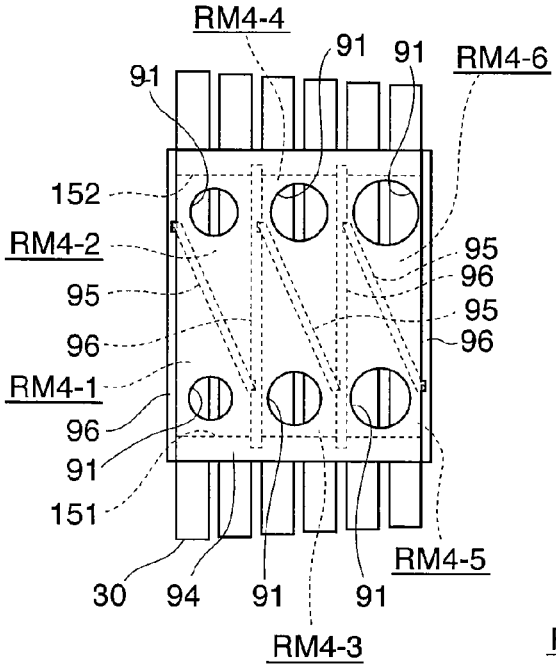
FIG. 19A is a fragmentary plan view showing a mid-pitch range portion of a resonance box according to a sixth embodiment of the present invention.
Figure 19C:
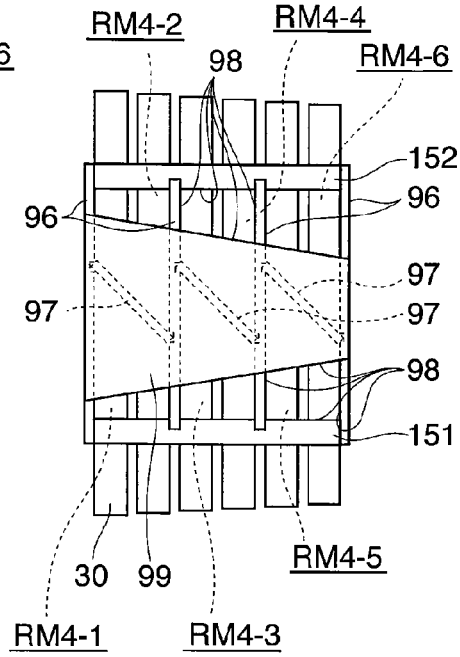
FIG. 19C is a fragmentary plan view showing a mid-pitch range portion according to a modification of the resonance box of the sixth embodiment.
Figure 19B:
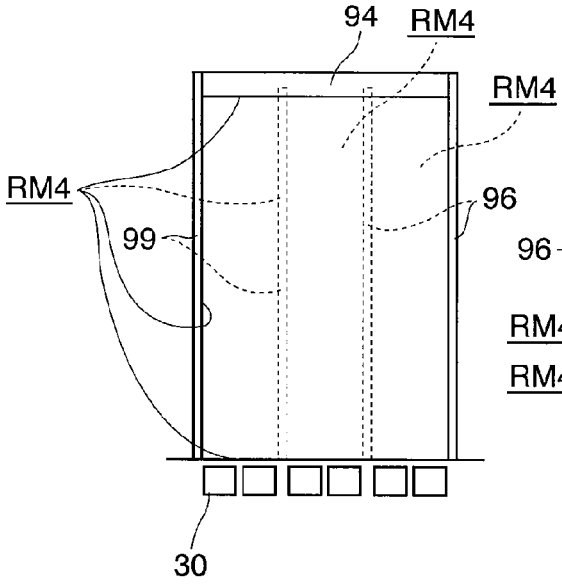
FIG. 19B is a fragmentary front view showing the mid-pitch range portion.

FIG. 19A is a fragmentary plan view showing a mid-pitch range portion of a resonance box according to the sixth embodiment, and FIG. 19B is a fragmentary front view showing the mid-pitch range portion.

In this resonance box, front and rear common walls 151, 152 corresponding to the front and rear common walls 51, 52 extend parallel to each other. The front and rear common walls 151, 152 may not extend in parallel over the entire resonance box. For example, the common walls may individually be provided for respective ones of those one or more blocks in the mid-pitch range portion in which the resonance chambers RM have the same height. There is provided one lid member 94 that corresponds to the lid member 57 and is only different in shape from the lid member 57 as seen in plan view, with the same construction of the through hole 91 as that of the fifth embodiment.

In one block, there are six spaces that form resonance chambers RM4 (RM4-1 to RM4-6) corresponding to the resonance chambers RM2, wherein these spaces are defined by the front and rear common walls 151, 152, the partition plate 96 corresponding to the partition plate 53, the inclined plate 95 corresponding to the inclined late 55, and the lid member 94.

As shown in FIGS. 19A and 19B, the six resonance chambers RM4 are the same in height and in widths in the front-to-rear and left-to-right directions. In other words, these chambers are the same in shape and volume from one another. However, the through holes 91 formed in the resonance chambers RM4 are different between the chambers. Since the thickness of the lid member 94 is uniform, the respective through holes 91 have the same depth.

Therefore, those resonance chambers RM4 which are larger in diameter of the through hole 91 are higher in resonance frequency. In the block concerned, the resonance chamber RM4-6 has the highest resonance frequency. As explained above, the resonance chambers RM4 are constructed that the through holes 91 formed therein are different in opening areas but the same in shape and volume, thereby permitting tone pitches sounded by the corresponding tone plates 30 to satisfactorily resonate in respective ones of these resonance chambers.

Figure 19D:
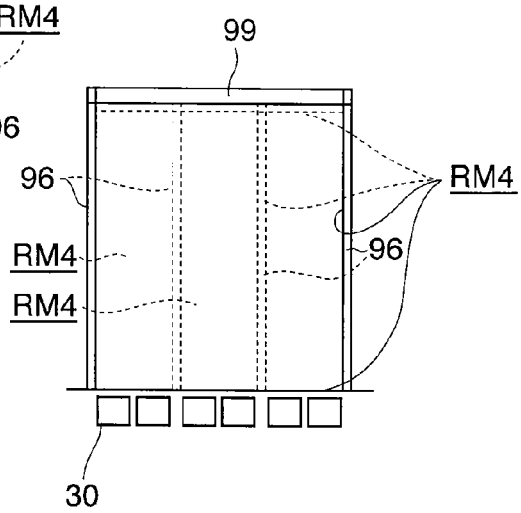
FIG. 19D is a fragmentary front view showing the mid-pitch range portion of the modification.

FIG. 19C is a fragmentary plan view showing a mid-pitch range portion according to a modification of the resonance box of the sixth embodiment, and FIG. 19D is a fragmentary front view showing the mid-pitch range portion.

This modification differs from the construction shown in FIGS. 19A and 19B in that the lid member is differently constructed. In FIGS. 19C and 19D, there is shown a block on the side higher in pitch than the block for the mid-pitch range portion shown in FIGS. 19A and 19B. To conform to such pitch range, the shape and mounting angle of the inclined plate 97 are different from those of the inclined plate 95, but these two plates have basically the same construction. The lid member 99 of this modification has a width in the front-to-rear direction that decreases toward the high-pitch range.

As viewed in plan, openings 98 are formed between the partition plates 96, the lid member 99, and the front or rear common walls 151 or 152. The openings 98 for those resonance chambers RM4 which are closer to the high-pitch range are made larger. Not clearly illustrated in the drawings, the openings 98 of the resonance chambers RM4-2, RM4-4, and RM4-6 are slightly wider than the openings 98 of the resonance chambers RM4-1, RM4-3, and RM4-5.

As described above, it is possible to construct the resonance chambers RM4 to permit tone pitches sounded by the corresponding tone plates 30 to resonate therein, by differing the opening areas of respective ones of the resonance chambers RM4 from one another by using the lid member 99 having a newly designed shape, instead of differing the opening areas of the through holes 91, while using the resonance chambers RM4 that are same in their shape and volume.

According to the present embodiment, effects similar to those attained by the fifth embodiment can be attained. In addition, since one block includes resonance chambers RM4 that are the same in shape and volume, the number of types of component parts (partition plate 96, inclined plate 95 or 96) of the resonance chambers RM4 can be reduced. In particular, according to the construction shown in FIGS. 19C and 19D, a fabrication step of forming through holes can be omitted, making it easy to fabricate the resonance chambers.

Next, an explanation will be given of a keyboard instrument 10 according to a seventh embodiment of the present invention. The keyboard instrument 10 includes a plurality of resonance tubes that are constructed individually. Instead of the resonance box 50 being mounted to the keyboard instrument 10, these resonance tubes constructed to have respective natural resonance frequencies are mounted thereto.

FIGS. 20A, 20C, 20E, and 20G are plan views showing resonance tubes 100 (100A to 100D) according to the seventh embodiment, and FIGS. 20B, 20D, 20F, and 20H are front views thereof. These four resonance tubes 100 are different from one another in whether or not a through hole (second opening) 104 (104B to 104D) is provided and how large the through hole is in diameter, but they are the same in other construction. Thus, a typical example shown in FIGS. 20C and 20D will be mainly explained.

Figures 20A, 20B, 20C, 20D, 20E, 20F, 20G, 20H:
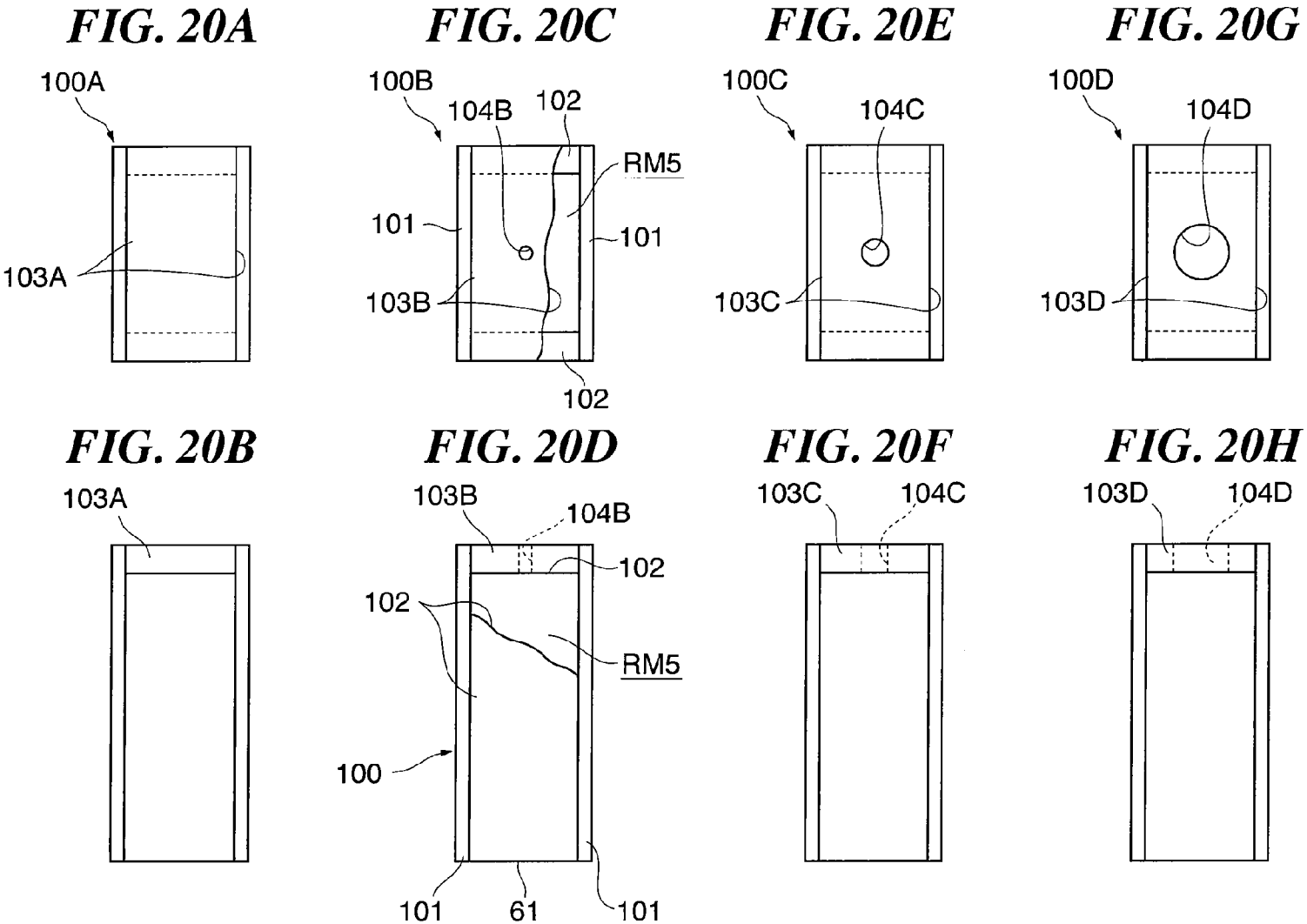

The resonance tube 100B shown in FIGS. 20C and 20D is comprised of two front and rear walls 102, 102, two right and left walls 101, 101, and a lid member 103B fixed to upper ends of the front and rear walls 102, wherein a resonance chamber RM5 is defined by these walls and lid member. When the resonance tube 100B is appropriately mounted to the keyboard 10, an opening 61 of the resonance chamber RM5 that opens downward is disposed close to the corresponding tone plate 30 in a facing relation therewith. In the resonance tube 100B, the front and rear walls 102 correspond to parts of the front and rear common walls 51, 52, and the lid member 103B corresponds to the lid member 57. Each individual resonance tube 100 corresponds to associated one of the tone plates 30.

The lid member 103B is formed with a through hole 104 corresponding to the through hole 91 (refer to FIGS. 17 and 19A). In FIG. 20, there are shown four types of resonance tubes 100, in which the resonance chambers RM5 are the same in shape and volume and the lid members 103 (103A to 103D) are the same in thickness. The diameter of the through hole 104 is equal to zero in the resonance tube shown in FIGS. 20A and 20B (which is a closed tube in actual), and is largest in the resonance tube shown in FIGS. 20G and 20H. Among the four types of resonance tubes 100, those tubes which are larger in diameter of the through hole 104 have a higher resonance frequency. Thus, the resonance tube 100D shown in FIGS. 20G and 20H is largest in resonance frequency.

According to the present embodiment, respective ones of the resonance chambers RM5 can be so constructed that the opening areas of the through holes 104 of the respective resonance tubes 100 are differed from one another, with the same shape and volume, thereby permitting tones having respective tone pitches and sounded by the tone plates 30 to resonate in the respective resonance chambers, and as a result the degree of freedom in designing the resonance tubes can be increased.

In the above, there are shown four types of the resonance tubes 100 by way of example, however, more than four types of resonance tubes can be fabricated by forming therein the through holes 104 that are differed in opening area. Moreover, resonance tubes 100 may be fabricated that have different resonance frequencies and correspond in number to the keys. In mounting such resonance tubes to the keyboard instrument 10, these resonance tubes may be combined into a single resonance box, which may subsequently be mounted to the keyboard instrument.

In the following, an eighth embodiment of the present invention will be explained. In the seventh embodiment, only the opening area of the through hole 104 is differed between the respective resonance tubes, thereby setting the respective desired resonance frequencies of the resonance tubes. On the contrary, in the present embodiment, such is realized by differing only the depth of the through hole between the resonance tubes.

Figure 21A:
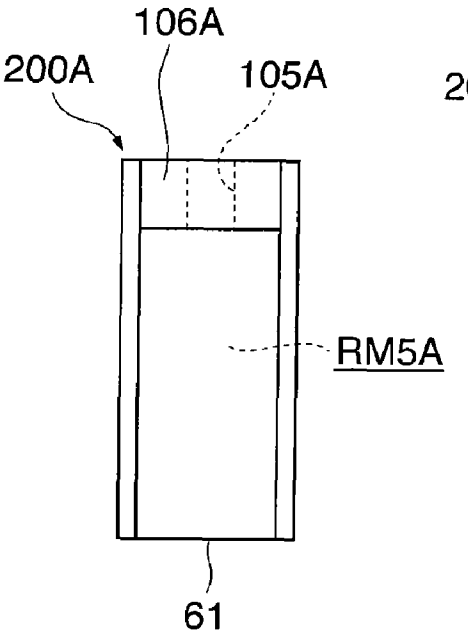
FIG. 21A is a front view of a resonance tube according to an eighth embodiment of the present invention.
Figure 21B:
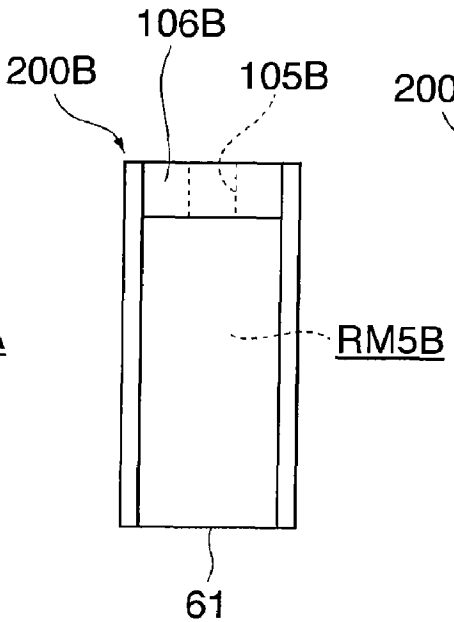
FIG. 21B is a front view showing another resonance tube.
Figure 21C:
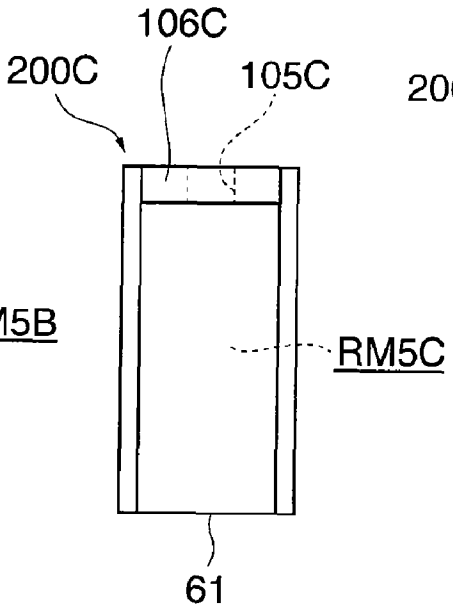
FIG. 21C is a front view showing still another resonance tube.
Figure 21D:
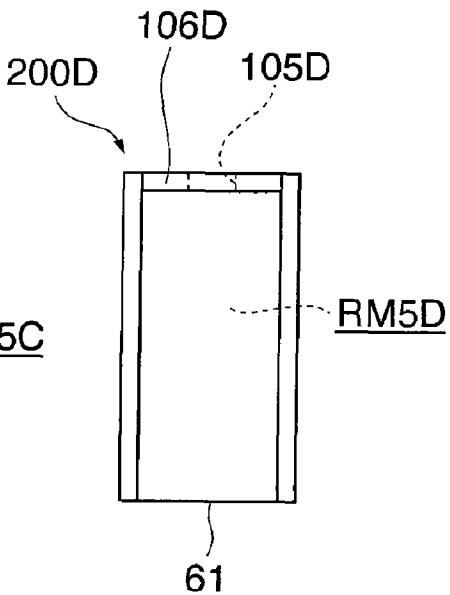
FIG. 21D is a front view showing a further resonance tube.

FIGS. 21A through 21D are front views showing resonance tubes according to the eighth embodiment. These resonance tubes 200 (200A to 200D) have the same basic construction as those of the seventh embodiment (refer to FIG. 20), in which the resonance chambers RM5 (RM5A to RM5D) are formed below the lid members 106 (106A to 106D). The lid members 106 are formed with the through holes (second openings) 105 (105A to 105D) which are the same in diameter. The lid members 106 have different thickness from one another, and accordingly the through holes 105 are different in depth. It should be noted that the resonance chambers RM5A to RM5D are the same in shape and volume. Among these four types of resonance tubes 200, those tubes which are shallower in depth of the through hole 105 are higher in resonance frequency. The resonance tube 200D shown in FIG. 21D is highest in resonance frequency.

According to the present embodiment, the resonance tubes 200 can be constructed that the through holes formed therein are different in depth but the same in shape and volume from one another, to thereby permit tones of different tone pitches sounded by respective ones of the corresponding tone plates 30 to resonate therein. Thus, in respect of improvement of the degree of freedom in designing the resonance tubes, the present embodiment can achieve effects similar to those attained by the seventh embodiment.

Figure 22A:
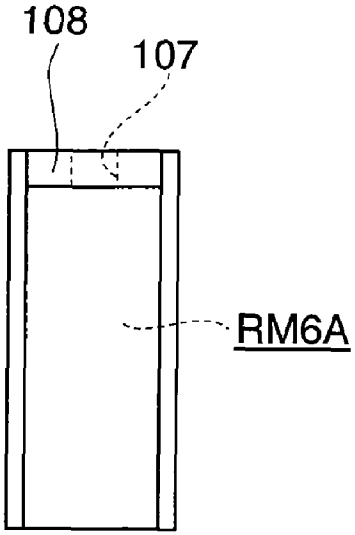
FIG. 22A is a front view showing a resonance tube according to a modification in which the volume of the resonance chamber is differed.
Figure 22B:
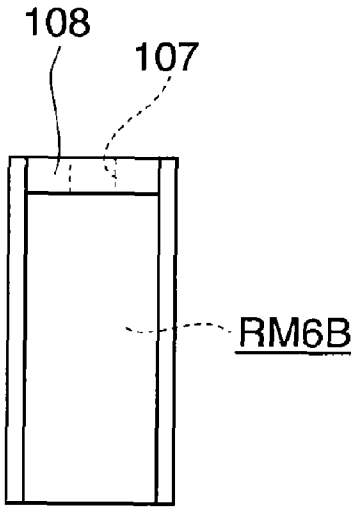
FIG. 22B is a front view showing a resonance tube according to another modification.
Figure 22C:
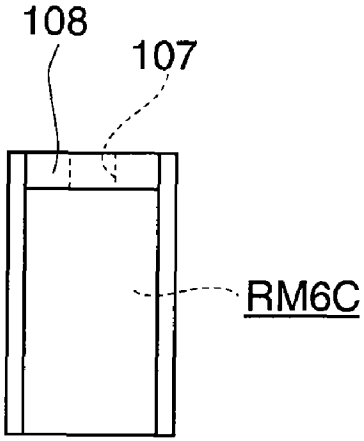
FIG. 22C is a front view showing a resonance tube according to still another modification.
Figure 22D:
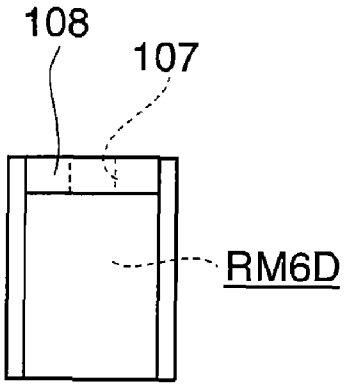
FIG. 22D is a front view showing a resonance tube according to a further modification.

As previously described, the resonance frequency of the resonance chamber can be adjusted by variably setting the volume of the resonance chamber as well as by variably setting the opening area and depth of an opening provided in the resonance chamber on the side thereof opposite from the corresponding tone plate 30. As shown by way of example in FIGS. 22A to 22D, even if the resonance chambers RM6 (RM6A to RM6D) are the same in opening area of the through hole (second opening) 107 and thicknesses of the lid members 108, it is possible for the respective resonance chambers to have different heights and hence different volumes, so that those resonance chambers which are smaller in volume have higher resonance frequencies. The resonance tube shown in FIG. 22D is highest in resonance frequency.

Therefore, in a case where the resonance tubes are fabricated individually, the resonance tubes may be constructed to have different resonance frequencies by appropriately combining resonance-frequency-related parameters. In that case, if the shapes and volumes are made equal between the resonance chambers RM, then it is possible to enhance structural commonality of component parts of the resonance chambers RM. If the diameters of through holes are made equal between the resonance chambers, a common drilling tool can be used to simplify the drilling process for the fabrication of resonance chambers. If the depths of through holes are made equal between the lid members, the same lid members can be used in the preparatory stage before the through holes are formed in the lid members. In that case, the lid members that are the same in thickness can easily be used for the plurality of resonance chambers (refer to the fifth embodiment), whereby the construction of and fabrication process for the resonance chambers can be simplified.

The above techniques of combining resonance-frequency-related parameters in the fabrication of resonance tubes can also be applied to the fabrication of the resonance box 50 having the plurality of resonance chambers as shown in the fifth embodiment. In that case, the resonance chambers and the through holes and lid members associated therewith can have the same construction therebetween.

Furthermore, it is also possible to design a variety of types of resonance tubes having the same resonance frequency and a variety of types of resonance chambers having the same resonance frequency by variously combining the related parameters. This makes it easy to design various resonance tubes and resonance chambers having various dimensions such as height thereof, so as to meet various types of keyboard instrument, thereby increasing the degree of freedom in designing keyboard instruments.

In the resonance box 50 of the tone generator unit UNT according to the fifth embodiment, the mid-pitch range portion 50B is constructed such that it is divided into five blocks having the partition plates 53 and resonance chambers RM2 of different heights, wherein four to six tone plates 30 are included in each individual block. The resonance chambers RM2 belonging to the same block have the same height, and thus there is no substantial difference between the volumes of the resonance chambers in the same block. Accordingly, in order to differentiate the resonance frequencies of the respective resonance chambers, it is necessary to greatly differentiate the opening areas of those through holes 91 which are adjacent to each other in the direction of array of the keys.

In a ninth embodiment of the present invention described below, therefore, each of the blocks that are different from one another in height of the partition plates 3 and the resonance chambers RM2 is constructed to include two tone plates 30.

Figure 23:
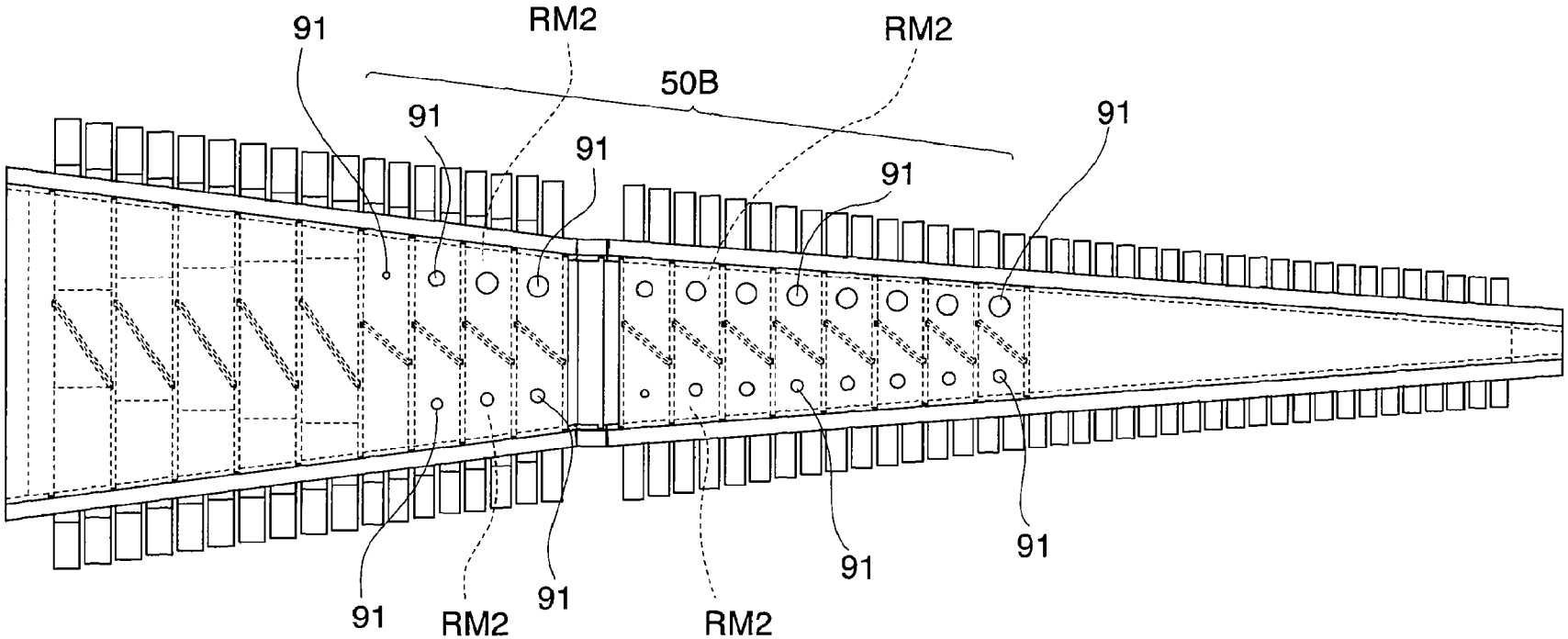
FIG. 23 is a plan view showing a tone generator unit in a tone plate percussion instrument according to a ninth embodiment of the present invention.

FIG. 23 is a plan view showing a tone generator unit in a tone plate percussion instrument according to the ninth embodiment. This tone generator unit UNT corresponds to a modification of the tone generator unit UNT of the fifth embodiment, and a front view is similar to FIG. 6. In other words, in the mid-pitch range portion 50B, the heights of the resonance chambers RM2 each including two tone plates 30 are made smaller toward the high-pitch range. It should be noted that all the through holes 91 are the same in depth.

The above construction in which the height of the resonance chamber RM2 is differentiated for every two tone plates 30 makes it easy to provide a volume difference between those resonance chambers RM2 which are adjacent in the direction of array of the keys, with the chamber volume becoming smaller toward the high-pitch range. As a result, unlike the construction shown in FIG. 16, it is unnecessary to provide a great difference in diameter between the through holes 91. In deed, in the tone generator unit UNT shown in FIG. 23, there is no substantial difference in diameter between those through holes 91 which are adjacent to each other in the direction in which the keys are arranged.

According to the construction of FIG. 23, advantages similar to those attained by the fifth embodiment can be achieved, and further a variation in sound volume between the respective resonance chambers RM2 can be suppressed due to the small difference in diameter between the through holes 91.

The present invention is also applicable to glockenspiels, to percussion instruments other than keyboard instruments, and to resonance tubes and resonance chambers therefor.

In each of the aforementioned embodiments, the resonance box and resonance tubes are not limited to ones made of wood. This also applies to the lid members. For example, in a case where the lid members 57 and the like in the fifth embodiment are formed by a resin, the through holes 91 (refer to FIGS. 16 and 17) and the like may be formed at the stage of die molding.

The through holes formed in the resonance box and resonance tubes are not limited to ones formed into a circular shape. The through holes are not limited in shape as long as they open to the side opposite from the tone plates.

What is claimed is:

1. A keyboard-type tone plate percussion instrument, comprising:

a plurality of keys that constitute a keyboard;

a plurality of tone plates each sounding a musical tone of a specific tone pitch when struck, the plurality of tone plates constituting all of the tone plates in the percussion instrument;

a plurality of percussion units arranged to respectively correspond to the plurality of keys and the plurality of tone plates, each percussion unit striking a corresponding one of the plurality of tone plates when driven by a depressing operation of a corresponding one of the plurality of keys, the plurality of percussion units constituting all of the percussion units in the percussion instrument; and a resonance box having a plurality of resonance chambers corresponding to respective ones of the plurality of tone plates, each of the resonance chambers having an opening side thereof facing and opening toward a corresponding one of the plurality of tone plates, first and second common walls in said resonance box extending substantially along the direction in which the plurality of tone plates are arranged, and a plurality of chamber-defining members that are formed between the first and second common walls and define the plurality of resonance chambers, wherein, among the plurality of resonance chambers, a plurality of predetermined resonance chambers corresponding to at least part of a range of the percussion instrument are defined to correspond, respectively, to associated ones of the plurality of tone plates, each of the plurality of predetermined resonance chambers overlaps at least one of other predetermined resonance chambers as seen from front thereof, wherein a maximum width of each of the plurality of predetermined resonance chambers as viewed in the direction in which the plurality of tone plates are arranged is as large as at least twice a width of the corresponding tone plate, wherein the plurality of tone plates are constructed into a single-stage structure where they are arranged in an order of tone pitch in a direction in which the plurality of keys are arranged so that tone plates neighboring in specific tone pitch are arranged adjacent to each other, and wherein the plurality of percussion units are constructed into a single-stage structure where they are arranged in the direction in which the plurality of keys are arranged so as to correspond to array of the plurality of tone plates.

2. The percussion instrument according to claim 1, wherein the plurality of percussion units are disposed on a side of the percussion instrument opposite from the resonance box with respect to the plurality tone plates, and the percussion instrument further includes sound output holes that are provided on a side of the percussion instrument opposite from the plurality of tone plates with respect to the plurality of percussion units.

3. A keyboard-type tone plate percussion instrument comprising, a plurality of keys that constitute a keyboard;

a plurality of tone plates each sounding a musical tone of a specific tone pitch when struck, the plurality of tone plates constituting all of the tone plates in the percussion instrument;

a plurality of percussion units arranged to respectively correspond to the plurality of keys and the plurality of tone plates, each percussion unit striking a corresponding one of the plurality of tone plates when driven by a depressing operation of a corresponding one of the plurality of keys, the plurality of percussion units constituting all of the percussion units in the percussion instrument; and a resonance box having a plurality of resonance chambers corresponding to respective ones of the plurality of tone plates and each having an opening side thereof close to a corresponding one of the plurality of tone plates, wherein each of the resonance chambers has a first opening thereof formed on the opening side of the resonance chamber, said first opening communicating with the resonance chamber, and facing and opening toward a corresponding one of the tone plates, wherein said each resonance chamber has a side thereof, opposite from the opening side, formed with a second opening that communicates with the resonance chamber, said second opening being located remote from and opening in a direction away from the corresponding one of the tone plates, wherein the plurality of tone plates are constructed into a single-stage structure where they are arranged in an order of tone pitch in a direction in which the plurality of keys are arranged so that tone plates neighboring in specific tone pitch are arranged adjacent to each other, and wherein the plurality of percussion units are constructed into a single-stage structure where they are arranged in the direction in which the plurality of keys are arranged so as to correspond to array of the plurality of tone plates.

4. A keyboard-type tone plate percussion instrument comprising, a plurality of keys that constitute a keyboard;

a plurality of tone plates each sounding a musical tone of a specific tone pitch when struck, the plurality of tone plates constituting all of the tone plates in the percussion instrument;

a plurality of percussion units arranged to respectively correspond to the plurality of keys and the plurality of tone plates, each percussion unit striking a corresponding one of the plurality of tone plates when driven by a depressing operation of a corresponding one of the plurality of keys, the plurality of percussion units constituting all of the percussion units in the percussion instrument; and a resonance box having a plurality of resonance chambers corresponding to respective ones of the plurality of tone plates and each having an opening side thereof close to a corresponding one of the plurality of tone plates, wherein each of the resonance chambers has a first opening thereof formed on the opening side of the resonance chamber, said first opening communicating with the resonance chamber, and facing and opening toward a corresponding one of the tone plates, wherein said each resonance chamber has a side thereof, opposite from the opening side, formed with a second opening that communicates with the resonance chamber, said second opening being located remote from and opening in a direction away from the corresponding one of the tone plates, wherein the second openings of the resonance chambers are different in at least one of opening area and opening depth from one another, whereby said each resonance chamber causes the musical tone of the specific tone pitch sounded by the corresponding one of the tone plates to resonate therein, wherein the plurality of tone plates are constructed into a single-stage structure where they are arranged in an order of tone pitch in a direction in which the plurality of keys are arranged so that tone plates neighboring in specific tone pitch are arranged adjacent to each other, and wherein the plurality of percussion units are constructed into a single-stage structure where they are arranged in the direction in which the plurality of keys are arranged so as to correspond to array of the plurality of tone plates.

5. A keyboard-type tone plate percussion instrument comprising, a plurality of keys that constitute a keyboard;

a plurality of tone plates each sounding a musical tone of a specific tone pitch when struck, the plurality of tone plates constituting all of the tone plates in the percussion instrument;

a plurality of percussion units arranged to respectively correspond to the plurality of keys and the plurality of tone plates, each percussion unit striking a corresponding one of the plurality of tone plates when driven by a depressing operation of a corresponding one of the plurality of keys, the plurality of percussion units constituting all of the percussion units in the percussion instrument; and a resonance box having a plurality of resonance chambers corresponding to respective ones of the plurality of tone plates and each having an opening side thereof close to a corresponding one of the plurality of tone plates, wherein said resonance box includes first and second common walls extending substantially along the direction in which the plurality of tone plates are arranged, and a plurality of chamber-defining members that are formed between the first and second common walls and define the plurality of resonance chambers, wherein among the plurality of resonance chambers, a plurality of predetermined resonance chambers corresponding to at least part of a range of the percussion instrument are defined to correspond, on a one on one basis, to associated ones of the plurality of tone plates, wherein each of the plurality of predetermined resonance chambers overlaps at least one of other predetermined resonance chambers as seen from front thereof, and wherein a maximum width of each of the plurality of predetermined resonance chambers as viewed in the direction in which the plurality of tone plates are arranged is as large as at least twice a width of the corresponding tone plate, wherein each of the resonance chambers has a first opening thereof formed on the opening side of the resonance chamber, said first opening communicating with the resonance chamber, and facing and opening toward a corresponding one of the tone plates, and wherein said each resonance chamber has a side thereof, opposite from the opening side, formed with a second opening that communicates with the resonance chamber, said second opening being located remote from and opening in a direction away from the corresponding one of the tone plates.

6. The percussion instrument according to claim 5, wherein each of the plurality of predetermined resonance chambers is in an overlap relation with the other one of the plurality of predetermined resonance chambers, those predetermined resonance chambers which are in the overlap relation with each other are substantially the same in height, and that predetermined resonance chamber which corresponds to a higher pitch range is smaller in height.

7. A keyboard-type tone plate percussion instrument comprising, a plurality of keys that constitute a keyboard;

a plurality of tone plates each sounding a musical tone of a specific tone pitch when struck, the plurality of tone plates constituting all of the tone plates in the percussion instrument a plurality of percussion units arranged to respectively correspond to the plurality of keys and the plurality of tone plates, each percussion unit striking a corresponding one of the plurality of tone plates when driven by a depressing operation of a corresponding one of the plurality of keys, the plurality of percussion units constituting all of the percussion units in the percussion instrument; and a resonance box having a plurality of resonance chambers corresponding to respective ones of the plurality of tone plates and each having an opening side thereof close to a corresponding one of the plurality of tone plates, wherein said resonance box includes first and second common walls extending substantially along the direction in which the plurality of tone plates are arranged, and a plurality of chamber-defining members that are formed between the first and second common walls and define the plurality of resonance chambers, wherein among the plurality of resonance chambers, a plurality of predetermined resonance chambers corresponding to at least part of a range of the percussion instrument are defined to correspond, on a one on one basis, to associated ones of the plurality of tone plates, wherein each of the plurality of predetermined resonance chambers overlaps at least one of other predetermined resonance chambers as seen from front thereof, and wherein a maximum width of each of the plurality of predetermined resonance chambers as viewed in the direction in which the plurality of tone plates are arranged is as large as at least twice a width of the corresponding tone plate, wherein each of the resonance chambers has a first opening thereof formed on the opening side of the resonance chamber, said first opening communicating with the resonance chamber, and facing and opening toward a corresponding one of the tone plates, wherein said each resonance chamber has a side thereof, opposite from the opening side, formed with a second opening that communicates with the resonance chamber, said second opening being located remote from and opening in a direction away from the corresponding one of the tone plates, and wherein the second openings of the resonance chambers are different in at least one of opening area and opening depth from one another, whereby said each resonance chamber causes the musical tone of the specific tone pitch sounded by the corresponding one of the tone plates to resonate therein.

8. A resonance box for use in a tone plate percussion instrument, which is disposed close to a plurality of tone plates and causes a musical tone generated by each of the tone plates to resonate therein, comprising:

first and second common walls extending substantially along a first direction in which the plurality of tone plates are arranged; and a plurality of chamber-defining members that are formed between said first and second common walls and define a plurality of resonance chambers, wherein, among the plurality of resonance chambers, a plurality of predetermined resonance chambers corresponding to at least part of a range of the percussion instrument are defined to correspond, in width and position, to associated respective ones of the plurality of tone plates, and wherein each of the plurality of predetermined resonance chambers has an opening that faces and opens toward at least two tone plates when the resonance chamber is used in the percussion instrument.

9. A resonance box according to claim 8, wherein a predetermined imaginary straight line passes through all the predetermined resonance chambers.

10. A resonance box according to claim 8, wherein each of the chamber-defining members includes a plurality of first plate members connected to at least one of said first and second common walls, and a plurality of second plate members connected to at least two of the first plate members.

11. A resonance tube unit for use in a tone plate percussion instrument having a plurality of tone plates, the resonance tube unit comprising:

a plurality of resonance tubes;

each of the resonance tubes having a resonance chamber that causes a musical tone generated by a respective one of the plurality of tone plate to resonate therein, each of the resonance chambers having substantially the same volumes, wherein each of said resonance chambers includes a first opening provided in communication with said resonance chamber, said first opening facing and opening toward a respective tone plate when the resonance tube unit is installed on the tone plate percussion instrument; and wherein each of at least two of said resonance chambers further includes a second opening provided in communication with its respective resonance chamber, said second openings are located remote from a respective tone plate and opening in a direction opposite from the respective tone plate when the resonance tube unit is installed on the tone plate percussion instrument, wherein the size of the second openings are different to produce different resonant frequencies.

12. A resonance box for use in a tone plate percussion instrument having a plurality of tone plates, comprising:

resonance chambers provided to correspond to respective ones of the plurality of tone plates, for causing musical tones generated by the plurality of tone plates to resonate therein, respectively wherein the resonance chambers are substantially the same in shape and volume from one another, wherein each of said resonance chambers includes a first opening provided in communication therewith, said first opening facing and opening toward a corresponding one of the tone plates when the resonance box is installed on the tone plate percussion instrument;

each said resonance chamber further includes a second opening provided in communication therewith, said second opening being located remote from and opening in a direction opposite from the corresponding one of the tone plates, wherein the size of the second openings are different to produce different resonance frequencies; and the second openings of the resonance chambers are different in at least one of opening area and opening depth from one another, whereby said each resonance chamber causes the musical tone of the specific tone pitch sounded by the corresponding one of the tone plates to resonate therein.

* * * * *